US008925274B2

(12) United States Patent
Darko et al.

(10) Patent No.: US 8,925,274 B2
(45) Date of Patent: Jan. 6, 2015

(54) MECHANICAL LOCKING OF BUILDING PANELS

(71) Applicant: Valinge Innovation AB, Viken (SE)

(72) Inventors: Pervan Darko, Viken (SE); Peterson Jan, Lerberget (SE)

(73) Assignee: Valinge Innovation AB, Viken (SE)

( * ) Notice: Subject to any disclaimer, the term of this patent is extended or adjusted under 35 U.S.C. 154(b) by 0 days.

(21) Appl. No.: 13/886,916

(22) Filed: May 3, 2013

(65) Prior Publication Data

US 2013/0239508 A1 Sep. 19, 2013

Related U.S. Application Data

(63) Continuation of application No. 13/329,019, filed on Dec. 16, 2011, now Pat. No. 8,448,402, which is a (Continued)

(30) Foreign Application Priority Data

May 15, 2008 (SE) ..... 0801114

(51) Int. Cl.

| | |
|---|---|
| ***E04B 2/00*** | (2006.01) |
| ***E04F 15/02*** | (2006.01) |
| ***E04F 21/22*** | (2006.01) |
| *E04F 15/04* | (2006.01) |

(52) U.S. Cl.

CPC ..... *E04F 15/02038* (2013.01); *E04F 15/02* (2013.01); *E04F 21/22* (2013.01); *E04F 15/04* (2013.01); *E04F 2201/0138* (2013.01); *E04F 2201/0153* (2013.01); *E04F 2201/0523* (2013.01); *E04F 2201/0541* (2013.01); *E04F 2201/0547* (2013.01); *Y10S 52/04* (2013.01)

USPC ..... 52/582.1; 52/127.7; 52/391; 52/588.1; 52/DIG. 4

(58) Field of Classification Search

CPC ..... A47G 1/17; A47K 5/05; F16B 2001/0035

USPC ..... 52/578, 588.1, 592.1, 390, 392, 533, 52/534, 553, 582.1, 586.1, 586.2, 589.1, 52/590.2, 590.3, 591.1, 591.5, 592.2, 52/592.4, 745.08, 745.17, 747.1, 747.11, 52/748.1, 748.11, 539, 127.7, 127.8, 52/DIG. 4; 403/334, 345, 364–368, 372, 403/375, 376, 381; 404/34, 35, 40, 41, 46, 404/47, 49–58, 68, 70; 428/44, 47–50, 57, 428/58, 60, 61, 106, 192–194

See application file for complete search history.

(56) References Cited

U.S. PATENT DOCUMENTS

| | | | |
|---|---|---|---|
| 87,853 | A | 3/1869 | Kappes |
| 108,068 | A | 10/1870 | Utley |

(Continued)

FOREIGN PATENT DOCUMENTS

| | | | |
|---|---|---|---|
| CA | 2456513 | A1 | 2/2003 |
| DE | 39 32 980 | A1 | 11/1991 |

(Continued)

OTHER PUBLICATIONS

U.S. Appl. No. 13/855,966, Boo.

(Continued)

*Primary Examiner* — William Gilbert

(74) *Attorney, Agent, or Firm* — Buchanan Ingersoll & Rooney P.C.

(57) ABSTRACT

Building panels (1, 1') are shown, which are provided with a mechanical locking system having tongue (30) of magnetic material that could be locked vertically by a magnetic field. And, a tongue including magnetic material and adapted for being received in a sidewardly open groove of a floor panel, wherein the tongue includes magnetic powder or particles.

8 Claims, 18 Drawing Sheets

Related U.S. Application Data continuation of application No. 12/518,584, filed as application No. PCT/SE2009/000250 on May 15, 2009, now Pat. No. 8,112,967.

(60) Provisional application No. 61/071,755, filed on May 15, 2008.

(56) References Cited

U.S. PATENT DOCUMENTS

| | | | | |
|---|---|---|---|---|
| 124,228 | A | | 3/1872 | Stuart |
| 213,740 | A | | 4/1879 | Conner |
| 274,354 | A | | 3/1883 | McCarthy et al. |
| 316,176 | A | | 4/1885 | Ransom |
| 634,581 | A | | 10/1899 | Miller |
| 861,911 | A | | 7/1907 | Stewart |
| 1,194,636 | A | | 8/1916 | Joy |
| 1,723,306 | A | | 8/1929 | Sipe |
| 1,743,492 | A | | 1/1930 | Sipe |
| 1,809,393 | A | | 6/1931 | Rockwell |
| 1,902,716 | A | | 3/1933 | Newton |
| 2,026,511 | A | | 12/1935 | Storm |
| 2,204,675 | A | | 6/1940 | Grunert |
| 2,277,758 | A | | 3/1942 | Hawkins |
| 2,430,200 | A | | 11/1947 | Wilson |
| 2,596,280 | A | | 5/1952 | Nystrom |
| 2,732,706 | A | | 1/1956 | Friedman |
| 2,740,167 | A | | 4/1956 | Rowley |
| 2,744,845 | A | * | 5/1956 | Rudoff ..... 442/253 |
| 2,863,185 | A | | 12/1958 | Riedi |
| 2,865,058 | A | | 12/1958 | Andersson |
| 2,889,016 | A | | 6/1959 | Warren |
| 3,023,681 | A | | 3/1962 | Worson |
| 3,077,703 | A | | 2/1963 | Bergstrom |
| 3,099,110 | A | | 7/1963 | Spaight |
| 3,147,522 | A | | 9/1964 | Schumm |
| 3,271,787 | A | | 9/1966 | Clary |
| 3,325,585 | A | | 6/1967 | Brenneman |
| 3,378,958 | A | | 4/1968 | Parks et al. |
| 3,396,640 | A | | 8/1968 | Fujihara |
| 3,512,324 | A | | 5/1970 | Reed |
| 3,517,927 | A | | 6/1970 | Kennel |
| 3,526,071 | A | | 9/1970 | Watanabe |
| 3,535,844 | A | | 10/1970 | Glaros |
| 3,572,224 | A | | 3/1971 | Perry |
| 3,579,941 | A | | 5/1971 | Tibbals |
| 3,620,543 | A | * | 11/1971 | Peis et al. ..... 280/601 |
| 3,720,027 | A | | 3/1973 | Christensen |
| 3,722,379 | A | | 3/1973 | Koester |
| 3,742,669 | A | | 7/1973 | Mansfeld |
| 3,760,547 | A | | 9/1973 | Brenneman |
| 3,760,548 | A | | 9/1973 | Sauer et al. |
| 3,778,954 | A | | 12/1973 | Meserole |
| 3,849,235 | A | | 11/1974 | Gwynne |
| 3,919,820 | A | | 11/1975 | Green |
| 3,950,915 | A | | 4/1976 | Cole |
| 4,007,994 | A | | 2/1977 | Brown |
| 4,030,852 | A | | 6/1977 | Hein |
| 4,064,571 | A | | 12/1977 | Phipps |
| 4,080,086 | A | | 3/1978 | Watson |
| 4,082,129 | A | | 4/1978 | Morelock |
| 4,100,710 | A | | 7/1978 | Kowallik |
| 4,107,892 | A | | 8/1978 | Bellem |
| 4,113,399 | A | | 9/1978 | Hansen, Sr. et al. |
| 4,169,688 | A | | 10/1979 | Toshio |
| 4,196,554 | A | | 4/1980 | Anderson |
| 4,227,430 | A | | 10/1980 | Jansson et al. |
| 4,299,070 | A | | 11/1981 | Oltmanns |
| 4,304,083 | A | | 12/1981 | Anderson |
| 4,426,820 | A | | 1/1984 | Terbrack |
| 4,447,172 | A | | 5/1984 | Galbreath |
| 4,512,131 | A | | 4/1985 | Laramore |
| 4,599,841 | A | | 7/1986 | Haid |
| 4,648,165 | A | | 3/1987 | Whitehorne |
| 5,007,222 | A | | 4/1991 | Raymond |
| 5,071,282 | A | | 12/1991 | Brown |
| 5,115,919 | A | * | 5/1992 | Dorman ..... 211/50 |
| 5,148,850 | A | | 9/1992 | Urbanick |
| 5,173,012 | A | | 12/1992 | Ortwein et al. |
| 5,182,892 | A | | 2/1993 | Chase |
| 5,247,773 | A | | 9/1993 | Weir |
| 5,272,850 | A | | 12/1993 | Mysliwiec et al. |
| 5,344,700 | A | | 9/1994 | McGath et al. |
| 5,348,778 | A | | 9/1994 | Knipp et al. |
| 5,465,546 | A | | 11/1995 | Buse |
| 5,485,702 | A | | 1/1996 | Sholton |
| 5,548,937 | A | | 8/1996 | Shimonohara |
| 5,598,682 | A | | 2/1997 | Haughian |
| 5,618,602 | A | | 4/1997 | Nelson |
| 5,634,309 | A | | 6/1997 | Polen |
| 5,658,086 | A | | 8/1997 | Brokaw et al. |
| 5,694,730 | A | | 12/1997 | Del Rincon et al. |
| 5,755,068 | A | | 5/1998 | Ormiston |
| 5,899,038 | A | | 5/1999 | Stroppiana |
| 5,950,389 | A | | 9/1999 | Porter |
| 5,970,675 | A | | 10/1999 | Schray |
| 6,006,486 | A | | 12/1999 | Moriau |
| 6,029,416 | A | | 2/2000 | Andersson |
| 6,052,960 | A | | 4/2000 | Yonemura |
| 6,065,262 | A | | 5/2000 | Motta |
| 6,173,548 | B1 | | 1/2001 | Hamar et al. |
| 6,182,410 | B1 | | 2/2001 | Pervan |
| 6,216,409 | B1 | | 4/2001 | Roy et al. |
| 6,314,701 | B1 | | 11/2001 | Meyerson |
| 6,363,677 | B1 | | 4/2002 | Chen et al. |
| 6,385,936 | B1 | | 5/2002 | Schneider |
| 6,418,683 | B1 | | 7/2002 | Martensson et al. |
| 6,446,413 | B1 | | 9/2002 | Gruber |
| 6,449,918 | B1 | | 9/2002 | Nelson |
| 6,490,836 | B1 | | 12/2002 | Moriau et al. |
| 6,505,452 | B1 | | 1/2003 | Hannig et al. |
| 6,553,724 | B1 | * | 4/2003 | Bigler ..... 52/36.1 |
| 6,591,568 | B1 | | 7/2003 | Pålsson |
| 6,601,359 | B2 | | 8/2003 | Olofsson |
| 6,617,009 | B1 | | 9/2003 | Chen et al. |
| 6,647,689 | B2 | | 11/2003 | Pletzer et al. |
| 6,647,690 | B1 | | 11/2003 | Martensson |
| 6,651,400 | B1 | | 11/2003 | Murphy |
| 6,670,019 | B2 | | 12/2003 | Andersson |
| 6,685,391 | B1 | | 2/2004 | Gideon |
| 6,763,643 | B1 | | 7/2004 | Martensson |
| 6,766,622 | B1 | | 7/2004 | Thiers |
| 6,769,219 | B2 | | 8/2004 | Schwitte et al. |
| 6,769,835 | B2 | | 8/2004 | Stridsman |
| 6,804,926 | B1 | | 10/2004 | Eisermann |
| 6,854,235 | B2 | | 2/2005 | Martensson |
| 6,862,857 | B2 | | 3/2005 | Tychsen |
| 6,865,855 | B2 | | 3/2005 | Knauseder |
| 6,874,291 | B1 | | 4/2005 | Weber |
| 6,880,307 | B2 | | 4/2005 | Schwitte et al. |
| 6,948,716 | B2 | | 9/2005 | Drouin |
| 7,021,019 | B2 | | 4/2006 | Knauseder |
| 7,040,068 | B2 | | 5/2006 | Moriau et al. |
| 7,051,486 | B2 | | 5/2006 | Pervan |
| 7,108,031 | B1 | | 9/2006 | Secrest |
| 7,121,058 | B2 | | 10/2006 | Pålsson et al. |
| 7,152,383 | B1 | | 12/2006 | Wilkinson et al. |
| 7,188,456 | B2 | | 3/2007 | Knauseder |
| 7,219,392 | B2 | | 5/2007 | Mullet et al. |
| 7,251,916 | B2 | | 8/2007 | Konzelmann et al. |
| 7,257,926 | B1 | | 8/2007 | Kirby |
| 7,337,588 | B1 | | 3/2008 | Moebus |
| 7,377,081 | B2 | | 5/2008 | Ruhdorfer |
| 7,451,578 | B2 | | 11/2008 | Hannig |
| 7,454,875 | B2 | | 11/2008 | Pervan et al. |
| 7,516,588 | B2 | | 4/2009 | Pervan |
| 7,533,500 | B2 | | 5/2009 | Morton et al. |
| 7,556,849 | B2 | | 7/2009 | Thompson et al. |
| 7,568,322 | B2 | | 8/2009 | Pervan |
| 7,584,583 | B2 | | 9/2009 | Bergelin et al. |
| 7,614,197 | B2 | | 11/2009 | Nelson |
| 7,617,651 | B2 | | 11/2009 | Grafenauer |
| 7,621,092 | B2 | | 11/2009 | Groeke et al. |
| 7,634,884 | B2 | | 12/2009 | Pervan |

(56) References Cited

U.S. PATENT DOCUMENTS

| | | | |
|---|---|---|---|
| 7,637,068 | B2 | 12/2009 | Pervan |
| 7,654,055 | B2 | 2/2010 | Ricker |
| 7,677,005 | B2 | 3/2010 | Pervan |
| 7,716,889 | B2 | 5/2010 | Pervan |
| 7,721,503 | B2 | 5/2010 | Pervan et al. |
| 7,726,088 | B2 | 6/2010 | Muehlebach |
| 7,757,452 | B2 | 7/2010 | Pervan |
| 7,802,411 | B2 | 9/2010 | Pervan |
| 7,806,624 | B2 | 10/2010 | McLean et al. |
| 7,841,144 | B2 | 11/2010 | Pervan et al. |
| 7,841,145 | B2 | 11/2010 | Pervan et al. |
| 7,861,482 | B2 | 1/2011 | Pervan et al. |
| 7,866,110 | B2 | 1/2011 | Pervan |
| 7,908,815 | B2 | 3/2011 | Pervan et al. |
| 7,930,862 | B2 | 4/2011 | Bergelin et al. |
| 7,980,039 | B2 | 7/2011 | Groeke |
| 7,980,041 | B2 | 7/2011 | Pervan |
| 8,033,074 | B2 | 10/2011 | Pervan |
| 8,042,311 | B2 | 10/2011 | Pervan |
| 8,061,104 | B2 | 11/2011 | Pervan |
| 8,079,196 | B2 | 12/2011 | Pervan |
| 8,112,967 | B2 | 2/2012 | Pervan et al. |
| 8,171,692 | B2 | 5/2012 | Pervan |
| 8,181,416 | B2 | 5/2012 | Pervan et al. |
| 8,234,830 | B2 | 8/2012 | Pervan et al. |
| 8,302,367 | B2 | 11/2012 | Schulte |
| 8,336,272 | B2 | 12/2012 | Prager et al. |
| 8,341,914 | B2 | 1/2013 | Pervan et al. |
| 8,341,915 | B2 | 1/2013 | Pervan et al. |
| 8,353,140 | B2 | 1/2013 | Pervan et al. |
| 8,359,805 | B2 | 1/2013 | Pervan et al. |
| 8,381,477 | B2 | 2/2013 | Pervan et al. |
| 8,387,327 | B2 | 3/2013 | Pervan |
| 8,448,402 | B2 | 5/2013 | Pervan et al. |
| 8,499,521 | B2 | 8/2013 | Pervan et al. |
| 2001/0024707 | A1 | 9/2001 | Andersson et al. |
| 2002/0031646 | A1 | 3/2002 | Chen et al. |
| 2002/0069611 | A1 | 6/2002 | Leopolder |
| 2002/0170259 | A1 | 11/2002 | Ferris |
| 2002/0178674 | A1 | 12/2002 | Pervan |
| 2002/0178680 | A1 | 12/2002 | Martensson |
| 2003/0009971 | A1 | 1/2003 | Palmberg |
| 2003/0024199 | A1 | 2/2003 | Pervan et al. |
| 2003/0037504 | A1 | 2/2003 | Schwitte et al. |
| 2003/0084636 | A1 | 5/2003 | Pervan |
| 2003/0094230 | A1 | 5/2003 | Sjoberg |
| 2003/0101681 | A1 | 6/2003 | Tychsen |
| 2003/0180091 | A1 | 9/2003 | Stridsman |
| 2003/0188504 | A1 | 10/2003 | Ralf |
| 2003/0196405 | A1 | 10/2003 | Pervan |
| 2004/0031227 | A1 | 2/2004 | Knauseder |
| 2004/0049999 | A1 | 3/2004 | Krieger |
| 2004/0060255 | A1 | 4/2004 | Knauseder |
| 2004/0068954 | A1 | 4/2004 | Martensson |
| 2004/0123548 | A1 | 7/2004 | Gimpel et al. |
| 2004/0128934 | A1 | 7/2004 | Hecht |
| 2004/0139676 | A1 | 7/2004 | Knauseder |
| 2004/0139678 | A1 | 7/2004 | Pervan |
| 2004/0168392 | A1 | 9/2004 | Konzelmann et al. |
| 2004/0182033 | A1 | 9/2004 | Wernersson |
| 2004/0182036 | A1 | 9/2004 | Sjoberg et al. |
| 2004/0200175 | A1 | 10/2004 | Weber |
| 2004/0211143 | A1 | 10/2004 | Hanning |
| 2004/0250492 | A1 | 12/2004 | Becker |
| 2004/0261348 | A1 | 12/2004 | Vulin |
| 2005/0028474 | A1 | 2/2005 | Kim |
| 2005/0050827 | A1 | 3/2005 | Schitter |
| 2005/0160694 | A1 | 7/2005 | Pervan |
| 2005/0166514 | A1 | 8/2005 | Pervan |
| 2005/0210810 | A1 | 9/2005 | Pervan |
| 2005/0235593 | A1 | 10/2005 | Hecht |
| 2005/0287500 | A1* | 12/2005 | Hubbard ..... 434/150 |
| 2006/0070333 | A1 | 4/2006 | Pervan |
| 2006/0101769 | A1 | 5/2006 | Pervan et al. |
| 2006/0156670 | A1 | 7/2006 | Knauseder |
| 2006/0236642 | A1 | 10/2006 | Pervan |
| 2006/0260254 | A1 | 11/2006 | Pervan |
| 2007/0006543 | A1 | 1/2007 | Engstrom |
| 2007/0028547 | A1 | 2/2007 | Grafenauer |
| 2007/0065293 | A1 | 3/2007 | Hannig |
| 2007/0108679 | A1 | 5/2007 | Grothaus |
| 2007/0151189 | A1 | 7/2007 | Yang et al. |
| 2007/0175156 | A1 | 8/2007 | Pervan et al. |
| 2007/0193178 | A1 | 8/2007 | Groeke et al. |
| 2007/0209736 | A1 | 9/2007 | Deringor et al. |
| 2008/0000185 | A1 | 1/2008 | Duernberger |
| 2008/0000186 | A1 | 1/2008 | Pervan et al. |
| 2008/0010931 | A1 | 1/2008 | Pervan et al. |
| 2008/0028707 | A1 | 2/2008 | Pervan |
| 2008/0034708 | A1 | 2/2008 | Pervan |
| 2008/0041008 | A1 | 2/2008 | Pervan |
| 2008/0066415 | A1 | 3/2008 | Pervan et al. |
| 2008/0104921 | A1 | 5/2008 | Pervan et al. |
| 2008/0110125 | A1 | 5/2008 | Pervan |
| 2008/0134607 | A1 | 6/2008 | Pervan et al. |
| 2008/0134613 | A1 | 6/2008 | Pervan |
| 2008/0134614 | A1 | 6/2008 | Pervan et al. |
| 2008/0155930 | A1 | 7/2008 | Pervan et al. |
| 2008/0216920 | A1 | 9/2008 | Pervan |
| 2008/0236088 | A1 | 10/2008 | Hannig |
| 2008/0295432 | A1 | 12/2008 | Pervan et al. |
| 2009/0019806 | A1 | 1/2009 | Muehlebach |
| 2009/0100782 | A1 | 4/2009 | Groeke et al. |
| 2009/0133353 | A1 | 5/2009 | Pervan et al. |
| 2009/0151290 | A1 | 6/2009 | Liu |
| 2009/0193741 | A1 | 8/2009 | Cappelle |
| 2009/0193748 | A1 | 8/2009 | Boo et al. |
| 2009/0193753 | A1 | 8/2009 | Schitter |
| 2009/0308014 | A1 | 12/2009 | Muehlebach |
| 2010/0043333 | A1 | 2/2010 | Hannig et al. |
| 2010/0083603 | A1 | 4/2010 | Goodwin |
| 2010/0173122 | A1 | 7/2010 | Susnjara |
| 2010/0293879 | A1 | 11/2010 | Pervan et al. |
| 2010/0300029 | A1 | 12/2010 | Braun et al. |
| 2010/0300031 | A1 | 12/2010 | Pervan et al. |
| 2010/0319291 | A1 | 12/2010 | Pervan et al. |
| 2011/0030303 | A1 | 2/2011 | Pervan et al. |
| 2011/0041996 | A1 | 2/2011 | Pervan |
| 2011/0088344 | A1 | 4/2011 | Pervan et al. |
| 2011/0088345 | A1 | 4/2011 | Pervan |
| 2011/0154763 | A1 | 6/2011 | Bergelin et al. |
| 2011/0167750 | A1 | 7/2011 | Pervan |
| 2011/0167751 | A1 | 7/2011 | Engstrom |
| 2011/0225922 | A1 | 9/2011 | Pervan et al. |
| 2011/0252733 | A1 | 10/2011 | Pervan et al. |
| 2011/0271632 | A1 | 11/2011 | Cappelle et al. |
| 2011/0283650 | A1 | 11/2011 | Pervan et al. |
| 2012/0017533 | A1 | 1/2012 | Pervan et al. |
| 2012/0031029 | A1 | 2/2012 | Pervan et al. |
| 2012/0036804 | A1 | 2/2012 | Pervan |
| 2012/0151865 | A1 | 6/2012 | Pervan et al. |
| 2012/0174515 | A1 | 7/2012 | Pervan |
| 2012/0174520 | A1 | 7/2012 | Pervan |
| 2012/0279161 | A1 | 11/2012 | Håkansson et al. |
| 2013/0008117 | A1 | 1/2013 | Pervan |
| 2013/0014463 | A1 | 1/2013 | Pervan |
| 2013/0019555 | A1 | 1/2013 | Pervan |
| 2013/0042562 | A1 | 2/2013 | Pervan |
| 2013/0042563 | A1 | 2/2013 | Pervan |
| 2013/0042564 | A1 | 2/2013 | Pervan |
| 2013/0042565 | A1 | 2/2013 | Pervan |
| 2013/0047536 | A1 | 2/2013 | Pervan |
| 2013/0081349 | A1 | 4/2013 | Pervan et al. |
| 2013/0111845 | A1 | 5/2013 | Pervan |
| 2013/0145708 | A1 | 6/2013 | Pervan |
| 2013/0160391 | A1 | 6/2013 | Pervan et al. |

FOREIGN PATENT DOCUMENTS

| | | | |
|---|---|---|---|
| DE | 299 22 649 | U1 | 4/2000 |
| DE | 199 40 837 | A1 | 11/2000 |
| DE | 199 58 225 | A1 | 6/2001 |
| DE | 202 05 774 | U1 | 8/2002 |
| DE | 203 20 799 | U1 | 4/2005 |

(56) References Cited

FOREIGN PATENT DOCUMENTS

| | | | |
|---|---|---|---|
| DE | 10 2004 055 951 | A1 | 7/2005 |
| DE | 10 2004 001 363 | A1 | 8/2005 |
| DE | 10 2004 054 368 | A1 | 5/2006 |
| DE | 10 2005 024 366 | A1 | 11/2006 |
| DE | 10 2006 024 184 | A1 | 11/2007 |
| DE | 10 2006 037 614 | B3 | 12/2007 |
| DE | 10 2006 057 491 | A1 | 6/2008 |
| DE | 10 2007 018 309 | A1 | 8/2008 |
| DE | 10 2007 032 885 | A1 | 1/2009 |
| DE | 10 2007 035 648 | A1 | 1/2009 |
| DE | 10 2007 049 792 | A1 | 2/2009 |
| EP | 0 013 852 | A1 | 8/1980 |
| EP | 0 871 156 | A2 | 10/1998 |
| EP | 0 974 713 | A1 | 1/2000 |
| EP | 1 308 577 | A2 | 5/2003 |
| EP | 1 350 904 | A2 | 10/2003 |
| EP | 1 350 904 | A3 | 10/2003 |
| EP | 1 420 125 | A2 | 5/2004 |
| EP | 1 437 457 | A2 | 7/2004 |
| EP | 1 640 530 | A2 | 3/2006 |
| EP | 1 650 375 | A1 | 4/2006 |
| EP | 1 650 375 | A8 | 9/2006 |
| EP | 1 980 683 | A2 | 10/2008 |
| EP | 2 017 403 | A2 | 1/2009 |
| FR | 1.138.595 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | 03-110258 | A | 5/1991 |
| JP | 05-018028 | A | 1/1993 |
| JP | 6-288017 | A | 10/1994 |
| JP | 6-306961 | A | 11/1994 |
| JP | 6-322848 | A | 11/1994 |
| JP | 7-300979 | A | 11/1995 |
| WO | WO 94/26999 | A1 | 11/1994 |
| WO | WO 97/47834 | A1 | 12/1997 |
| WO | WO 98/22677 | A1 | 5/1998 |
| WO | WO 00/20705 | A1 | 4/2000 |
| WO | WO 00/43281 | A1 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/02670 | A1 | 1/2001 |
| WO | WO 01/02672 | A1 | 1/2001 |
| WO | WO 01/48332 | A1 | 7/2001 |
| WO | WO 01/51732 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/98604 | A1 | 12/2001 |
| WO | WO 02/48127 | | 6/2002 |
| WO | WO 03/016654 | A1 | 3/2003 |
| WO | WO 03/025307 | A1 | 3/2003 |
| WO | WO 03/074814 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/016877 | A1 | 2/2004 |
| WO | WO 2004/020764 | A1 | 3/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/003488 | A1 | 1/2005 |
| WO | WO 2005/054599 | A1 | 6/2005 |
| WO | WO 2006/043893 | A1 | 4/2006 |
| WO | WO 2006/050928 | A1 | 5/2006 |
| WO | WO 2006/104436 | A1 | 10/2006 |
| WO | WO 2006/123988 | A1 | 11/2006 |
| WO | WO 2007/015669 | A2 | 2/2007 |
| WO | WO 2007/079845 | A1 | 7/2007 |
| WO | WO 2007/089186 | A1 | 8/2007 |
| WO | WO 2007/141605 | A2 | 12/2007 |
| WO | WO 2007/142589 | A1 | 12/2007 |
| WO | WO 2008/004960 | A2 | 1/2008 |
| WO | WO 2008/004960 | A8 | 1/2008 |
| WO | WO 2008/017281 | A1 | 2/2008 |
| WO | WO 2008/017301 | A2 | 2/2008 |
| WO | WO 2008/017301 | A3 | 2/2008 |
| WO | WO 2008/060232 | A1 | 5/2008 |
| WO | WO 2008/068245 | A1 | 6/2008 |
| WO | WO 2009/116926 | A1 | 9/2009 |
| WO | WO 2010/070472 | A2 | 6/2010 |
| WO | WO 2010/070605 | A2 | 6/2010 |
| WO | WO 2010/087752 | A1 | 8/2010 |
| WO | WO 2010/108980 | A1 | 9/2010 |
| WO | WO 2010/136171 | A1 | 12/2010 |

OTHER PUBLICATIONS

U.S. Appl. No. 13/855,979, Boo et al.

U.S. Appl. No. 61/774,749, Nygren, et al.

Boo, Christian, U.S. Appl. No. 13/855,966, entitled "Building Panel with a Mechanical Locking System," filed Apr. 3, 2013.

Boo, Christian, et al., U.S. Appl. No. 13/855,979, entitled "Method for Producing a Mechanical Locking System for Building Panels," filed Apr. 3, 2013.

Nygren, Per, et al., U.S. Appl. No. 61/774,749, entitled "Building panels provided with a Mechanical Locking System," filed Mar. 8, 2013.

International Search Report mailed Aug. 6, 2009 in PCT/SE2009/000250, Swedish Patent Office, Stockholm, Sweden, 8 pages.

Plaintiff'S First Amended Complaint and Counterclaim on Reply, *Akzenta Paneele + Profile GmbH and W. Classen GmbH & Co. KG* v. *Shaw Industries Group, Inc. and Valinge Innovation AB and Darko Pervan*, United States District Court for the Eastern District of Texas, Marshall Division, Case No. 2:10-CV-16, dated Nov. 30, 2010, and attachments thereto.

European prosecution file history, European Patent No. 1863984 (Appln. No. 06700664), dated Oct. 5, 2006 to Sep. 9, 2010.

Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.

Engstrand, Ola (Contact)/Välinge Innovation AB, Technical Disclosure entitled "VA-038 Mechanical Locking of Floor Panels With Vertical Folding," IP com No. IPCOM000179246D, Feb. 10, 2009, IP.com Prior Art Database, 59 pages.

Engstrand, Ola (Contact)/Välinge Innovation AB, Technical Disclosure entitled "VA043 5G Linear Slide Tongue," IP.com No. IPCOM000179015D, Feb. 4, 2009, IP.com Prior Art Database, 126 pages.

* cited by examiner

Prior Art

MECHANICAL LOCKING OF BUILDING PANELS

CROSS-REFERENCE TO RELATED APPLICATIONS

This application is a continuation of application Ser. No. 13/329,019, filed on Dec. 16, 2011, which is a continuation of application Ser. No. 12/518,584, filed Oct. 15, 2009, which is a National Stage of Application No. PCT/SE09/00250, filed May 15, 2009, which claims the benefit of Swedish Application No. 0801114-0, filed on May 15, 2008, and claiming benefit under 35 USC 119(e) to U.S. Application No. 61/071,755, filed May 15, 2008. The contents of application Ser. No. 13/329,019, application Ser. No. 12/518,584, Application No. PCT/SE09/00250, Swedish Application No. 0801114-0, and U.S. Application No. 61/071,755 are hereby expressly incorporated by reference.

AREA OF INVENTION

The invention generally relates to the field of building panels with mechanical locking systems comprising a separate displaceable tongue allowing easy installation. The invention provides new improved locking systems and methods to install and disconnect building panels, especially building panels and methods to produce the locking system.

BACKGROUND OF THE INVENTION

In particular, yet not restrictive manner, the invention concerns a mechanical locking system for rectangular building panels with long and short edges. It should be emphasized that long and short edges are only used to simplify the description. The panels could also be square, they could have more than 4 edges and the adjacent edges could have angles other than 90 degrees. However, the invention is as well applicable to building panels in general. More particularly the invention relates mainly to the type of mechanically locking systems, which allow that angling of long edges and vertical movement of short edges could lock all four edges of a panel to other panels.

A floor panel of this type is presented in WO2006/043893, (FIG. 1*a*) which discloses a floor panel with a locking system comprising a locking element cooperating with a locking groove, for horizontal locking, and a flexible tongue (30) cooperating with a tongue groove (20), for locking in a vertical direction. The flexible tongue bends in the horizontal plane and snaps into the tongue groove during connection of the floor panels and makes it possible to install the panels by vertical snap folding or solely by vertical movement. Similar floor panels are further described in WO2003/016654, which discloses locking system comprising a tongue with a flexible tab. The tongue is extending and bending essentially in a vertical direction and the tip of the tab cooperates with a tongue groove for vertical locking.

Vertical locking and vertical folding of this type creates a separation pressure at the short edges when the flexible tongue or flexible parts of the tongue are displaced horizontally in a double action during the angling of the long edges. Parts of the tongue are displaced inwardly during the initial part of the locking and they are thereafter displaced towards the initial position during the final part of the locking action. The inventor has analyzed several types of floor panels and discovered that there is a considerable risk that the short edges could be pushed away from each other during installation and that a gap could occur between the edge portions of the short edges. Such a gap could prevent further installation and the floor panels will not be possible to connect. It could also cause serious damage to the locking system at the short edges. Pushing the floorboards sideways towards the short edges during installation could prevent the gap. Such an installation method is however complicated and difficult to use since three actions have to be combined and used simultaneously in connection with angling down of the long edges.

It is also known, as shown in FIG. 1*b* that two adjacent short edges in a first row could be locked with a displaceable tongue (30), which is displaced and, for example, bended by a side push at one edge section (32) when the adjacent short edges have been folded down and positioned in the same plane. Such an installation is described in DE 1020060376114B3 and a pre published PCT application made by Välinge innovation AB. This vertical push folding, which generally is activated by a pressure from a long side of a third panel in a second row, displaces the separate tongue along the short edge joint but also perpendicular to the joint direction such that a part of the tongue is displaced into a groove of the adjacent short edge. This displacement perpendicular to the joint direction avoids the separation forces during the vertical folding but creates a separation force when the panels are laying flat on the sub floor and when the tongue is pressed into the tongue groove of the adjacent panel. This side push pressure parallel to the joint must be converted to a pressure force perpendicular to the edge and this is a disadvantage since a considerable part of the pressure will be lost and cannot be used to create a strong locking force that brings the edges in the same plane in case that they are warped. Most vertical push folding systems, especially such systems that comprise a flexible tongue that bends in the length direction of the joint, are difficult to lock when the first and the last rows are installed. They are not suitable to lock wide panels. Some of these problems could be avoided with a wedge shaped tongue. Such wedge shape tongues consist generally of two parts or they are connected to grooves, which are not parallel with the edge. This leads to the fact that expensive materials or complicated production methods must be used.

JP 3110258 (Matsushita) discloses a raised floor for office buildings, e.g. in a computer room, with a high requirement of access to cables or pipes under the front face. The raised floor comprises units, which can be locked, after they have been positioned on the sub-floor, with a displaceable magnetic tongue, which is displaced from one groove in one edge of a unit to another groove in an adjacent unit with a magnetic force. Matsushita teaches that such floorings cannot be provided with tongues.

DEFINITION OF SOME TERMS

In the following text, the visible surface of the installed floor panel is called "front face", while the opposite side of the floor panel, facing the sub floor, is called "rear face". The edge between the front and rear face is called "joint edge". If not defined otherwise upper and lower mean towards the front face and towards the rear face, respectively. Inner and outer means towards or away from the centre of the panel. By "horizontal plane" is meant a plane, which extends parallel to the outer part of the surface layer. Immediately juxtaposed upper parts of two adjacent joint edges of two joined floor panels together define a "vertical plane" perpendicular to the horizontal plane. By "horizontally" is meant parallel with the horizontal plane and by "Vertically" parallel to the vertical plane.

By "joint" or "locking system" are meant co acting connecting means, which connect the floor panels vertically and/ or horizontally. By "mechanical locking system" is meant that joining can take place without glue. Mechanical locking systems can in many cases also be combined with gluing. By "integrated with" means formed in one piece with the panel or factory connected to the panel. By "separate" parts, components element and similar is meant that they are produced separately and not in one piece with the core or the main body of the panel. Separate parts are generally factory connected and integrated with the panel but they could be supplied as lose parts, which are intended to be used during installation of panels.

By a "separate tongue" is meant a tongue, which is made of a separate material, connected to one edges of a panel, which has a length direction along the joint edges and is forming a part of the vertical locking system.

By a "displaceable tongue" is meant any type of a tongue which connects adjacent edges vertically and which is made of a separate material and connected to a floor panel and which is wholly or partly displaceable between an unlocked position and a locked position. A displaceable tongue could be flexible or rigid By "tongue" is generally meant a part in an edge section that extends beyond the upper edge and cooperates with a groove in an adjacent edge such that the edges are locked vertically. A tongue is generally made in one piece with the panel.

By "angling" is meant a connection that occurs by a turning motion, during which an angular change occurs between two parts that are being connected, or disconnected. When angling relates to connection of two floor panels, the angular motion takes place with the upper parts of joint edges at least partly being in contact with each other, during at least part of the motion.

By an "angling locking system" is meant a mechanical locking system which could be connected vertically and horizontally with angling comprising a tongue and a groove that locks two adjacent edges in a vertical direction and a locking strip with a locking element in one edge of a panel called "strip panel" that cooperates with a locking groove on another edge of a panel called "groove panel" and locks the edges in a horizontal direction. The locking element and the locking groove have generally rounded guiding surfaces that guide the locking element into the locking groove and locking surfaces that locks and prevents horizontal separation between the edges.

By "vertical folding" is meant installation of panels with angling of long edges where this long edge angling also is used to connect the short edges. By "vertical snap folding" is meant an installation where the short edges are locked with snapping of a flexible tongue during the final stage of the long edge angling. Such a locking system is not a pure combination of, for example, an angling locking system on long edges and a vertical locking system on short edges since the vertical and the angling actions are combined and the short edges are folded together in the same way as scissors. The locking takes place gradually from one edge section adjacent to one long edge, which is angled, to the other edge section adjacent to the other opposite long edge. By "vertical push folding" is meant an installation where the short edges of two panels are locked when they are laying flat on a sub floor after the angling. The locking is obtained by a side push that displaces a separate tongue in the length direction of the short edges. The horizontal locking is in known fold down systems obtained in the same way as for the angling systems with a locking element in one edge of a strip panel that cooperates with a locking groove on another edge of a groove panel By "vertical locking" is meant a locking that take place when two edges are displaced essentially vertically against each other.

SUMMARY OF THE INVENTION

The present invention aims at a set of building panels, especially floor panels or a floating flooring with a mechanical locking system, preferably on the short edges, which is configured to improve installation of floor panels, preferably installed with vertical folding or vertical locking, such that separation forces of the short edges during installation are reduced or completely eliminated. The aim of the invention is also to simplify installation such that locking and preferably even unlocking could be accomplished without any vertical or horizontal pressure force or any displacement of the panels.

The invention provides for new embodiments of locking systems according to different aspects offering respective advantages. Useful areas for the invention are wall panels, ceilings, exterior applications and floor panels of any shape and material e.g. laminate; especially thin floating floor panels with a thickness of up to about 15 mm and with surface materials which contain thermosetting resins, wood, HDF, veneer, paint stone or similar.

The invention comprises, according to a first aspect, a set of floor panels provided with a mechanical locking system comprising a displaceable magnetic tongue at a first edge of a first floor panel and a tongue groove at another adjacent second edge of a similar second floor panel for connecting the edges in a second vertical direction. The adjacent edges comprise a protruding locking strip in one of the adjacent edges cooperating with the other one of adjacent edges for connecting the edges in a first vertical direction. The locking system is configured to be activated by a magnetic field such that at least a part of the magnetic tongue is displaced from the first edge into the tongue groove.

The invention offers the advantages that the panel edges will be locked in a first vertical direction and aligned when the edges are folded together and the protruding locking strip is cooperating with the adjacent edge. The magnetic tongue could then be displaced by a magnetic force into a locked position whereby the edges are locked in a second vertical direction. It is preferred that the tongue groove has an opening which is larger than the thickness of the outer part of the magnetic tongue such that a space exists between the tongue groove and the upper part of the magnetic tongue. The magnetic tongue will preferably only lock in a second vertical direction with its lower part against the lower part of the tongue groove and this will eliminate production tolerances and allow a displacement with a rather low pulling force.

A specific objective of the invention is to displace magnetic tongue into a groove in a reliable way and to prevent that the tongue moves back in an uncontrolled way.

The locking system comprises, according to a preferred embodiment, a tongue-locking device, which prevents the magnetic tongue to be displaced from the tongue groove towards the first edge such that the second vertical connection is released.

The tongue-locking device prevents that the magnetic tongue moves in the groove when the magnetic force is removed. Such an embodiment offers several advantages. A long-term use with repeating pressures, applied at the edges by people walking on the floor, could cause a magnetic tongue to partly or completely move back towards the unlocked position if the locking system does not comprise a tongue-locking device. Such uncontrolled unlocking is a major problem especially in thin floating wood and laminate floors that are installed on a flexible underlay of, for example, foam and where the panel edges are displaced vertical when people walk over the floor surface.

Embodiments of the first aspect of the invention are concerned with several different types of tongue locking devices, e.g. a magnet arranged in an edge section of a panel, tongue locking protrusion, preferably with a vertical snap function, which protrudes vertically from the rest of the tongue or a tilt-able tongue with sharp edges. The tongue-locking device is preferably configured such that the tongue is easier to slide into the tongue groove and to the locked position compared to sliding in the reverse and un-locked direction. Specific embodiments comprise flexible tongue locking devices that are released when a magnetic force is applied and locked when a magnetic force is removed. Gravity and grooves that are not parallel with the main plane of the panel could also be used to prevent uncontrolled displacement. Displacement in two directions, for example perpendicularly to and parallel with the joint edge, could also be used and displacement towards an unlocked position could also be prevented if a magnetic tongue located at a short edge is locked with its edge sections against long edges of adjacent panels in adjacent rows. The magnetic tongue could also comprise surfaces with different friction properties, which are active during locking and unlocking and could provide easy locking and considerable resistance against unlocking.

The invention comprises, according to a preferred embodiment, a set of floor panels, which are locked by a magnetic field caused by a magnet applied on a floor surface. It is an advantage if the magnetic tongue is located in a groove which is positioned as close as possible to the floor surface such that a magnet could be applied close to the magnetic tongue in order to create a strong magnetic pulling force. The tongue groove should preferably be located at a distance from the floor surface that does not exceed about 0.1 times the floor thickness. Such a distance could be about 2-5 mm in 7-10 mm laminate floors and 15 mm wood floors.

The invention comprises, according to a preferred embodiment, a set of floor panels, which are locked by a magnetic field caused by a magnet arranged in an edge section of a panel. Such a magnet will lock automatically when the edges are aligned and it will keep the magnetic tongue in a permanent locked position.

This first aspect allows that the panels are, for example, unlocked vertically until a magnet field displaces a separate tongue and locks the panels. Such a magnetic locking could, for example, take place optionally during the installation of two panels or after the installation of all panels in a floor. One or several magnets, which could be arranged as an installation tool and which produce a magnetic field, could be applied on a floor surface adjacent to the locking system as soon as two panels are laying flat on a sub floor with their adjacent edges in an essentially common plane. A locking element, for example a displaceable magnetic tongue located in a displacement groove, could be displaced by the magnetic field such that it partly enters into a groove of an adjacent edge and locks the panels vertically. The tongue could comprise any suitable magnetic material such as iron, nickel, cobalt and any alloys that contain proportions of these metals. Injection moulded parts consisting of various types of resins and magnetic powder or particles could also be used to form a displaceable tongue comprising magnetic material such that it could be attracted by a magnet. Such a tongue is hereafter called "magnetic tongue". This definition should be interpreted broadly unless otherwise specified and a magnetic tongue could also be a magnet that attracts other magnets or other magnetic materials. The most preferred embodiment is however a magnetic tongue that comprises magnetic material and that is not a magnet.

One or several permanent magnets could be used to activate a magnetic tongue. Such magnets are well known. They consist of magnetic hard material, such as for example steal and metal alloys that are permanently magnetized by a strong magnetic field. Impermanent magnets can also be used, for example, an electromagnet where an electric current generates a magnetic field.

Locking and unlocking of a magnetic locking system is very simple. The magnet is just displaced from one edge to the other edge. The position of the magnet in relation to the joint edges could be used to indicate a locked and unlocked position.

Angling down and up again of a panel could be made in a simple way according to known technology since there is no tongue that creates any locking resistance as in the known vertical snap folding systems or vertical push folding systems. An additional advantage is that the magnetic tongue could be made rigid and preferably with a very simple, essentially rectangular form.

The main principle of the invention could be used to displace a magnetic locking element in any direction along and perpendicular to the joint, vertically or horizontally and in any direction that combines such displacements. The main principles of the invention could be used to lock floor panels horizontally by a substantially vertical displacement of a magnetic tongue. Even turning is possible. The principle could be used to lock panels vertically and/or horizontally and could be used on long and/or short edges and even in panels with more than four edges.

The tongue-locking device could be used to lock the tongue in an inner position in the displacement groove and in an outer position where the magnetic tongue is located in the tongue groove. A magnet could be used to release the tongue from this inner locked position, displace the tongue into the tongue groove and to activate the tongue-locking device by removing the magnet. It is preferred that the tongue-locking device also serves as a connection to fix the magnetic tongue in the displacement groove during transport.

The invention comprises according to a second aspect a method to connect a set of floor panels vertically and/or horizontally. The panels are provided with a locking system comprising a protruding locking strip at an edge, a magnetic tongue located in one edge of a first floor panel and a tongue groove in an adjacent edge of a second floor panel wherein the method comprises the steps of:

Positioning the edges of the first and second panel adjacent to each other and in essentially the same plane by locating one of the edges against the protruding strip.

Connecting the edges by displacing the magnetic tongue into the tongue groove by applying a magnetic field.

The method comprises according to a preferred embodiment an additional step of locking the magnetic tongue horizontally in a locked position.

All references to "a/an/the [element, device, component, means, step, etc.]" are to be interpreted openly as referring to at least one instance of said element, device, component, means, step, etc., unless explicitly stated otherwise.

Almost all embodiments are described with separate tongues on the strip panel mainly in order to simplify the description. The separate tongue could be located optionally in the edge of the groove panel or the strip panel and even on both edges.

BRIEF DESCRIPTION OF THE DRAWINGS

Embodiments of the invention will now be described with reference to the enclosed Figures, which are for the purpose of illustration of various non-limiting embodiments of the invention, of which.

DESCRIPTION OF EMBODIMENTS OF THE INVENTION

Figure 1A:
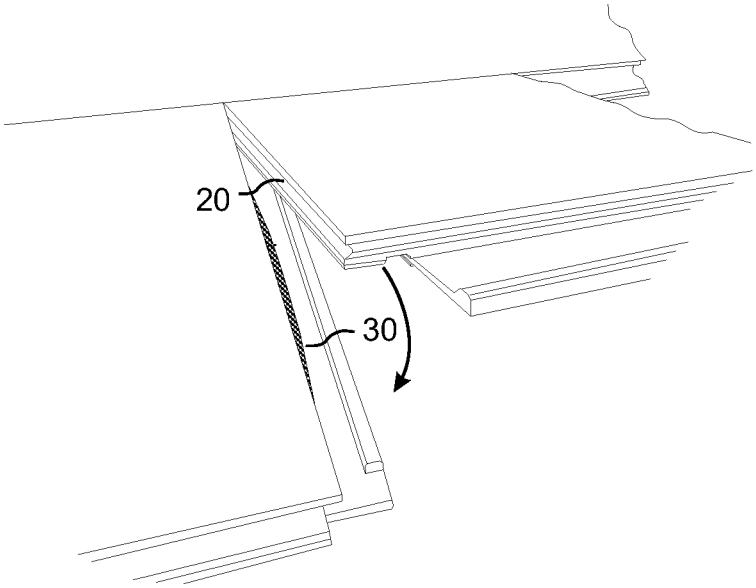
FIGS. 1*a-b* illustrate a prior art locking system.
Figure 1B:
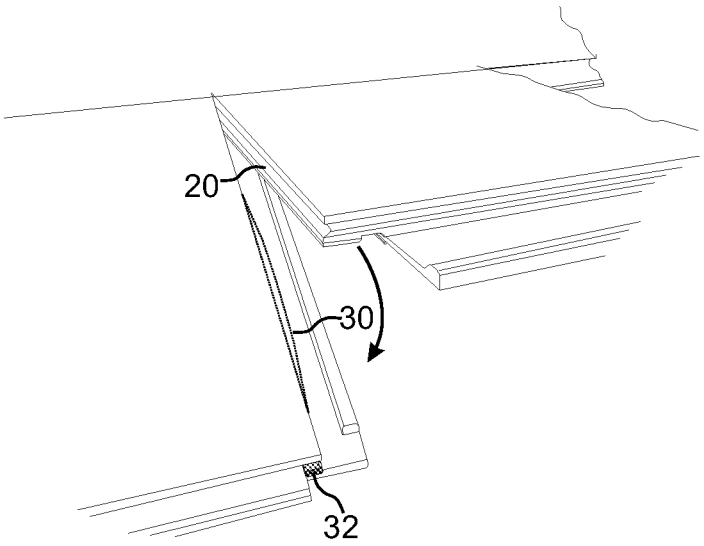
Figure 2A:
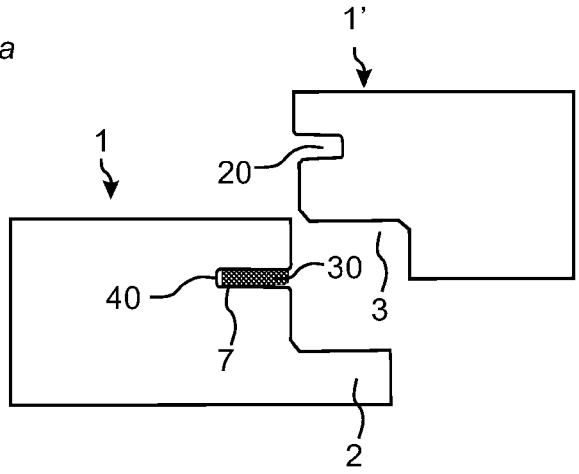
FIGS. 2*a-e* show an embodiment of the invention with a magnetic locking system provided with a protruding strip.
Figure 2B:
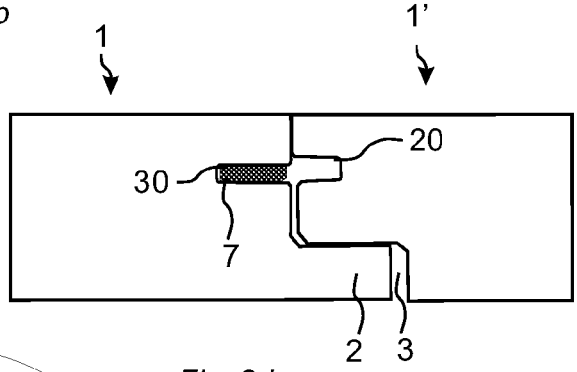
Figure 2C:
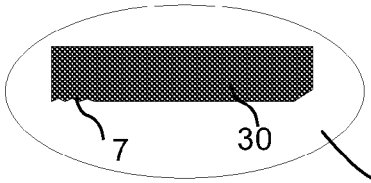
Figure 2D:
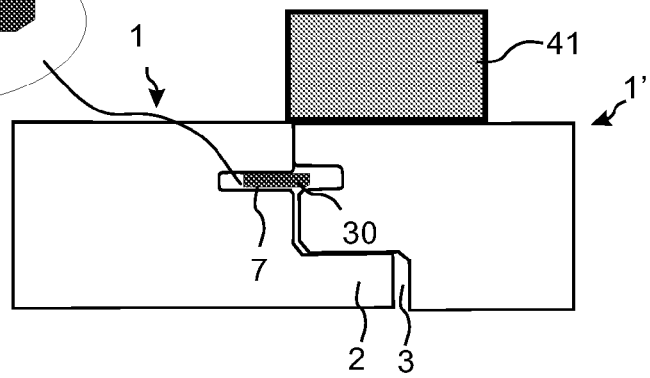
Figure 2E:
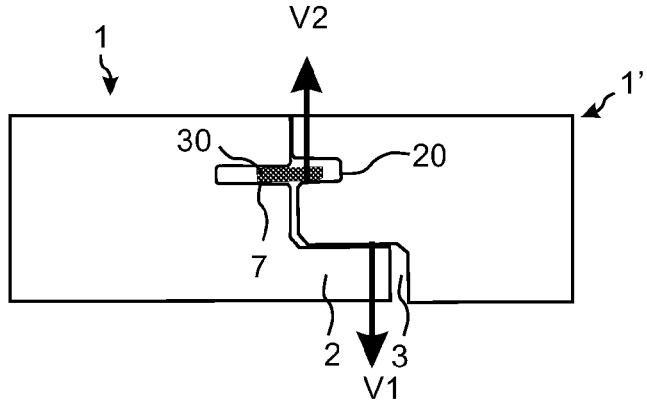

FIGS. 2*a* and 2*b* shows one embodiment of panels 1, 1' with a magnetic locking system according to the invention. The locking system is in this embodiment of the invention used to lock two edges vertically V1, V2. A first panel 1 has a displaceable tongue 30 of magnetic material arranged in a displacement groove 40 formed in the edge of the first panel 1. The second panel 1' comprises a tongue groove 20. The panels comprise a protruding locking strip 2 in one edge that cooperates with a cavity 3 in an adjacent edge and locks the edges in a first vertical direction V1 when the second panel 1' is moved preferably vertically along a vertical plane VP and arranged in the same plane as the first floor panel 1. FIG. 2*d* shows that the magnetic tongue 30 is displaced horizontally into the tongue groove 20 when a magnet 41 is arranged on the floor surface, preferably essentially on the surface of the second panel 1'. The whole tongue 30 is displaced in the displacement groove. The tongue is lifted upwards by the magnetic force and slides along its upper surface until it is locked against the tongue groove 20 and prevents the edges to move vertically in a second vertical direct ion V2. The tongue is in this locked position slightly tilted upwards. FIG. 2*c* show that the magnetic tongue comprises a tongue-locking device 7 which grips with a friction force against the lower part of the displacement groove 40 and prevents the tongue to slide back in an unlocked position. The locking system could be unlocked if the magnet 41, for example, is applied on the surface and is displaced towards the first edge 1. Such unlocking will lift the tongue upwards and the tongue-locking device will be released.

Figure 3A:
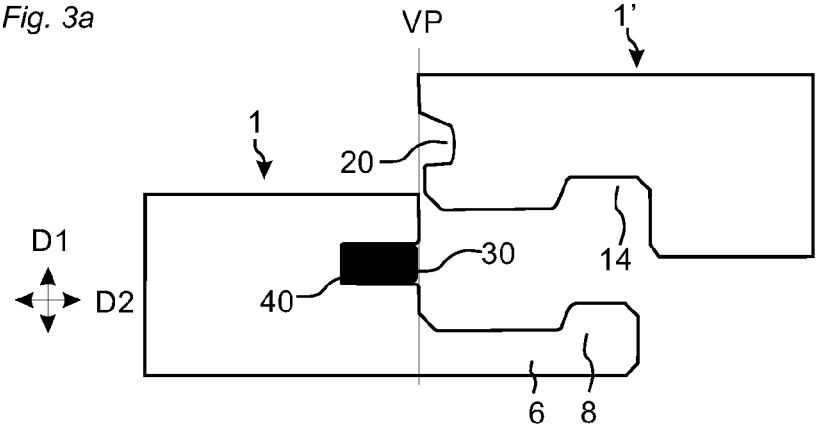
FIGS. 3*a-d* show an embodiment with a magnetic locking system provided with a locking strip and a locking element.
Figure 3B:
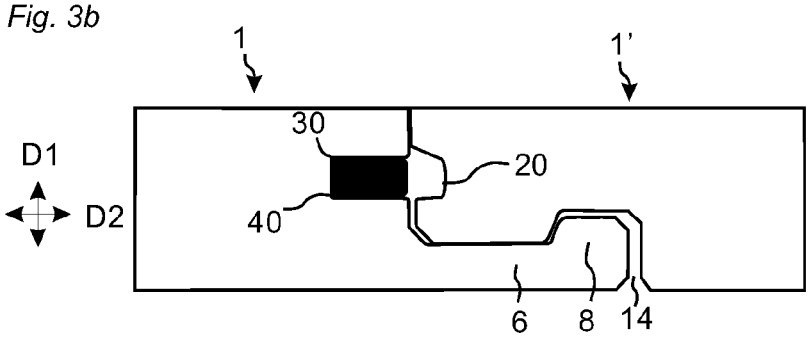
Figure 3C:
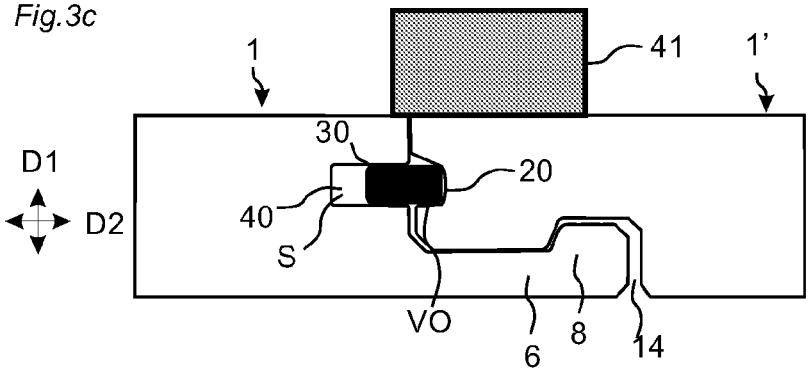
Figure 3D:
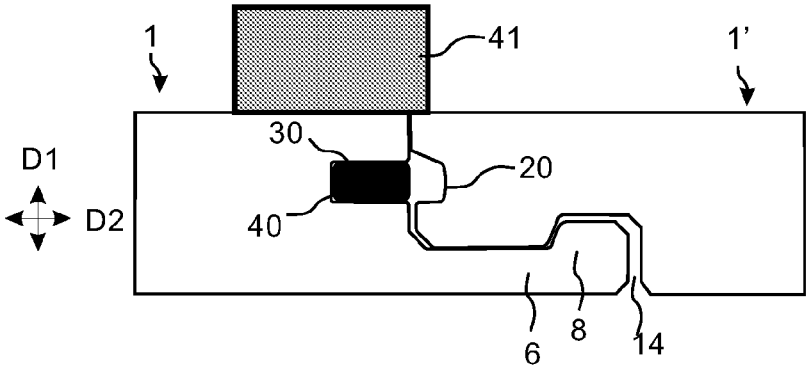

FIG. 3*a* shows one embodiment of panels 1, 1' with a magnetic locking system according to the invention. The locking system is in this embodiment of the invention used to lock two edges vertically D1 and horizontally D2. A first panel 1 has a displaceable tongue 30 of magnetic material arranged in a displacement groove 40 formed in the edge of the first panel 1. The second panel 1' comprises a tongue groove 20. The panels comprise a strip 6 with a locking element 8 in one edge that cooperates with a locking groove 14 in an adjacent edge and locks the edges in a horizontal direction D2 according to known technology as shown in FIG. 3*b* when the second panel 1' is moved preferably vertically along a vertical plane VP and arranged in the same plane as the first floor panel 1. FIG. 3*c* shows that the magnetic tongue 30 is displaced horizontally into the tongue groove 20 when a magnet 41 is arranged on the floor surface, preferably essentially on the surface of the second panel 1'. The whole tongue 30 is displaced in the displacement groove and in locked position there is a space S in the inner part of the displacement groove 40. This space is essentially of the same magnitude as the vertical overlapping VO of the tongue 30 and the lower part of the tongue groove 20. FIG. 3*d* shows that the magnetic locking system could be unlocked if the magnet 41, for example, is displaced towards the first edge 1' or if the magnetic field is changed.

A displaceable tongue of magnetic material could be connected with friction in a displacement groove 40 formed in the panel core. Magnetic displacement could be facilitated if wax or similar friction reducing materials are applied in the groove. The magnetic tongue 30 could also be arranged in a separate material, such as for example a U formed plastic section, in order to facilitate displacement in, for example, a high friction core. A magnetic material could also be used to displace a tongue that is made of a non-magnetic material. Tongues of non-magnetic materials could, for example, have one or two edge sections, which are magnetic. A magnetic tongue could be made of several material types mixed with iron powder. According to one embodiment a magnetic tongue is provided comprising wood fibres, iron powder and a thermosetting binder.

Figure 4A:
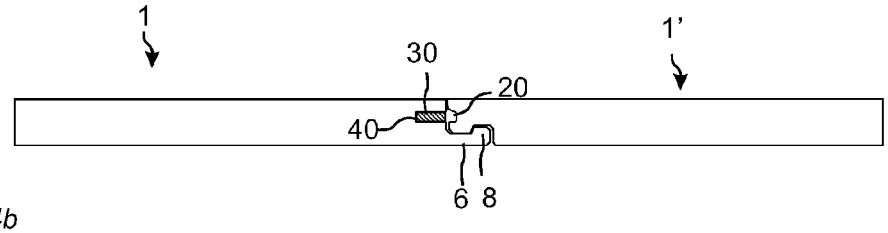
FIGS. 4*a-c* show an embodiment of vertical locking with an installation tool comprising permanent magnets.
Figure 4B:
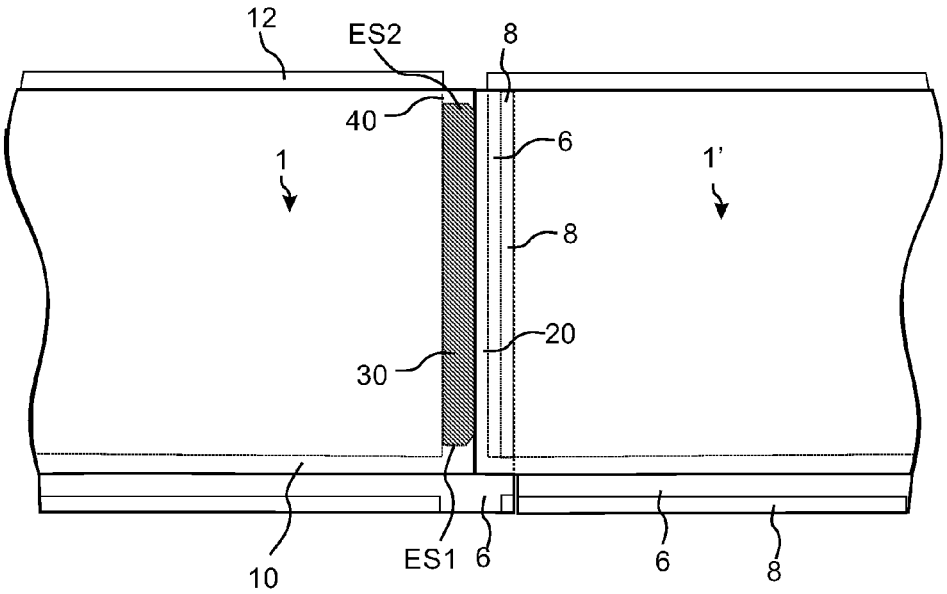
Figure 4C:
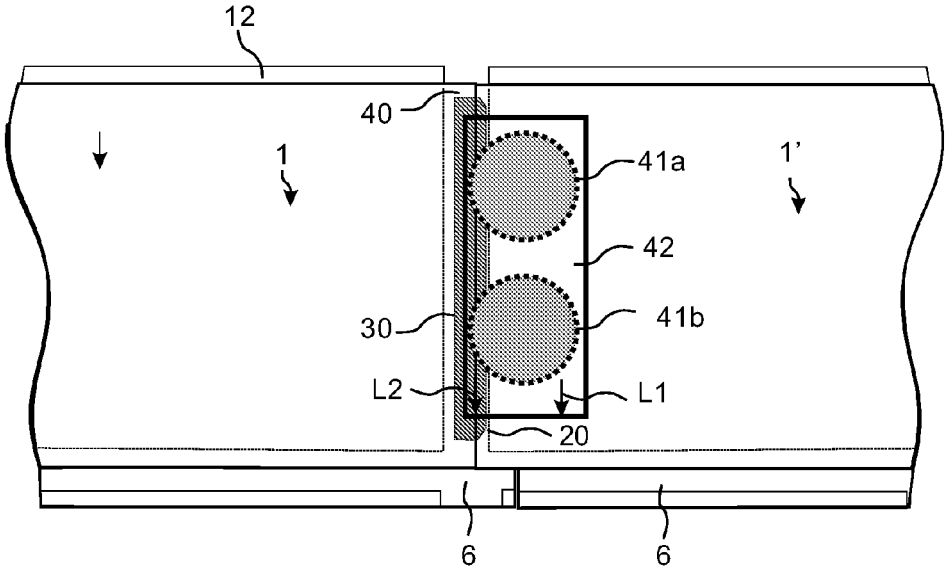

FIG. 4*a-c* shows essentially the same locking function seen from the floor surface. The displaceable magnetic tongue 30 could be made of metal, for example iron or steal or it could be an injection-moulded element comprising magnetic particles. The displaceable tongue 30 could preferably be made of a material, which is rigid. It is preferred that the displaceable tongue 30 is rigid in the displacement direction. Such a tongue could create a strong locking. It is preferred that the whole tongue 30 in the unlocked position is located completely in the displacement groove 40 such that the outer part is located essentially at or inside a vertical plane VP, as shown in FIG. 3*a*. It is also preferred that the edge parts ES1, ES2 are spaced from the long side tongue 12 or groove 10. The edges could preferably be rounded in order to facilitate easy locking and sliding into the tongue groove (20). FIGS. 4*a* and 4*b* show the unlocked position and FIG. 4*c* shows the locked position. An installation tool 42 with two magnets 41*a*, 41*b* could, for example, be used. Each magnet could create a pulling force on the tongue of, for example, 10N or more. Several magnets could be used and very strong pulling forces could be created. It is possible to design an installation tool such that it automatically takes a pre-determined position in relation to, for example, the joint edges depending on the position of the displaceable tongue 30. The locked position L2 and the unlocked position L1 could be marked and it is very easy to see if the magnetic lock is locked or unlocked.

An installation tool could also be designed such that it could be rolled along a panel row and automatically lock all edges in the row.

Permanent magnets could be produced with low cost and they could have many different shapes. Many types of magnets could be used in a magnetic installation of floor panels.

Several modifications are possible. The tongue could be designed to lock permanently into the tongue groove 20 with, for example, friction connections. The locking element 8 in FIG. 4*a* could, for example, be replaced with a magnetic locking element in a vertically extending displacement groove such that a magnetic field lock the panels horizontally. The displaceable tongue and the tongue groove could comprise protrusions and cavities such that a horizontal and/or vertical locking could be obtained by a displacement along the edge caused by a magnetic field. The locked position could be indicated by a sound that is created when the magnetic field pulls the tongue into the locked position. The magnetic tongue could be made by, for example, roll forming or punching of a metal sheet. Such a tongue could have a vertical extension, for example 2 mm, which is larger than the thickness of the steel sheet that, for example, could have a thickness of 1 mm or less. Such tongue, which is shown in FIG. 13*d*, could lock in a groove which is larger than the steel sheet and which is easier to cut with large rotating tools.

Figure 5A:
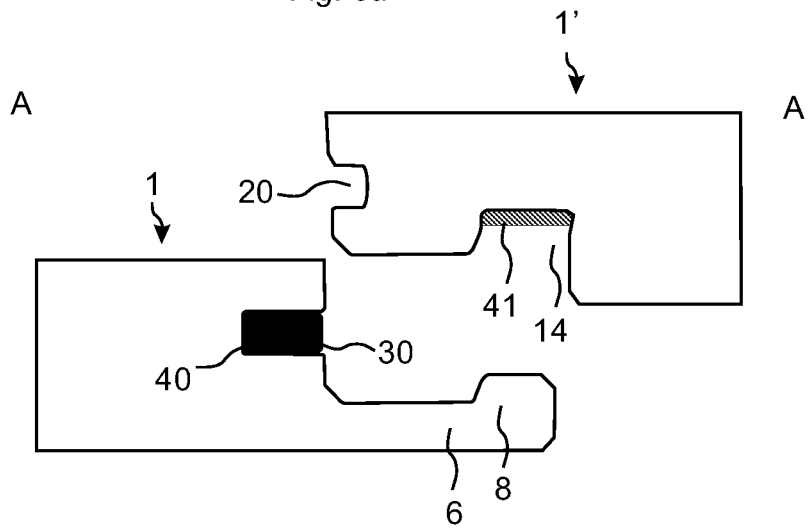
FIGS. 5*a-c* show an embodiment of vertical folding of floor panels comprising a magnetic locking system with a permanent magnet arranged on an edge.
Figure 5B:
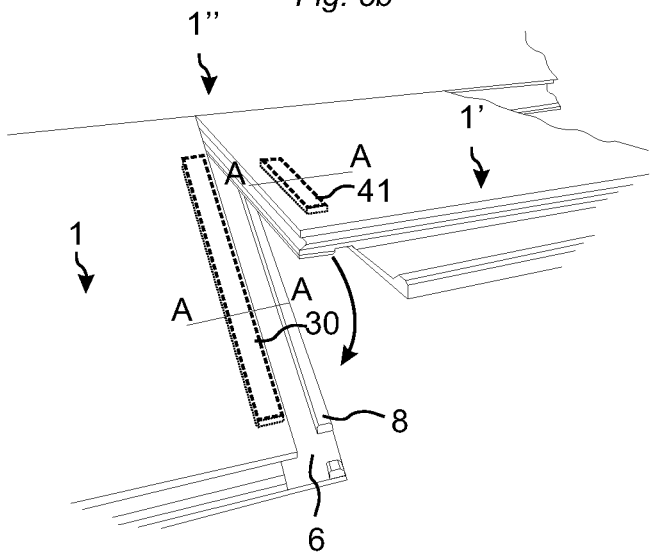
Figure 5C:
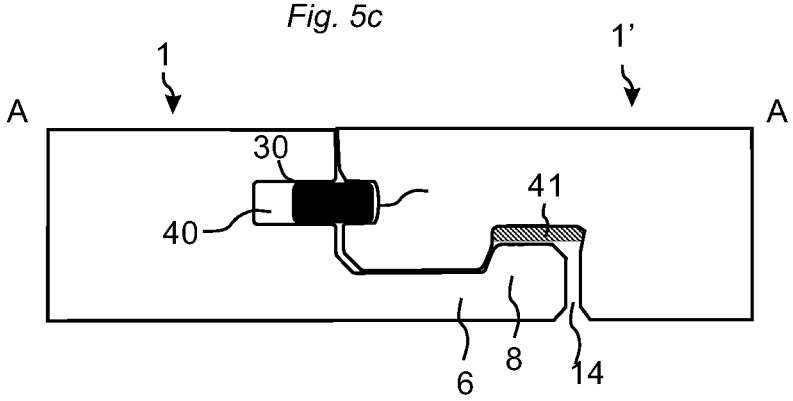

FIGS. 5*a*-5*c* show that a permanent magnet 41 could be arranged in the edge of the second panel 1', for example, in the locking groove 14, in the tongue groove 20 or in any groove made in the rear side of the panel. FIG. 5*a* shows the position of the cross sections A-A of FIG. 5*b* during installation. FIG. 5*b* shows vertical folding where a second panel 1' is locked with angling to a previously installed panel 1" in a first row. The permanent magnet 41 will automatically pull the magnetic tongue 30 into the tongue groove 20 when the first 1 and the second 1' panels are in the same plane as shown in FIG. 5*c*.

Figure 6A:
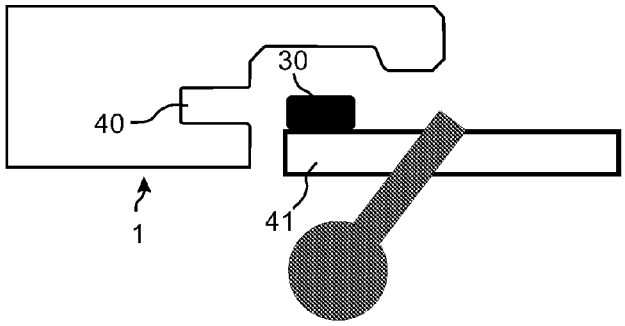
FIGS. 6*a-b* show an embodiment of fixing of a magnetic tongue.
Figure 6B:
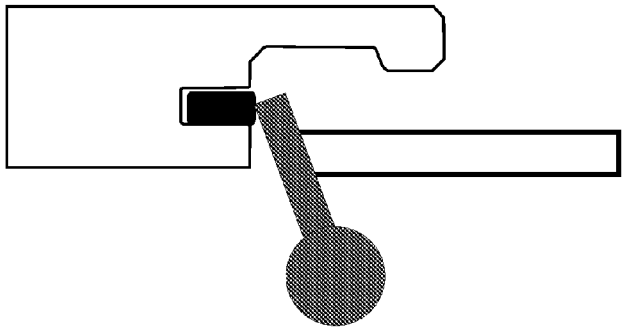

FIGS. 6*a* and 6*b* shows that a separate element comprising magnetic material could be used to simplify fixing of a tongue 30 into a groove 40 if a magnet 41 is used to keep the tongue 30 in a pre-determined position by a magnetic field.

Figure 6C:
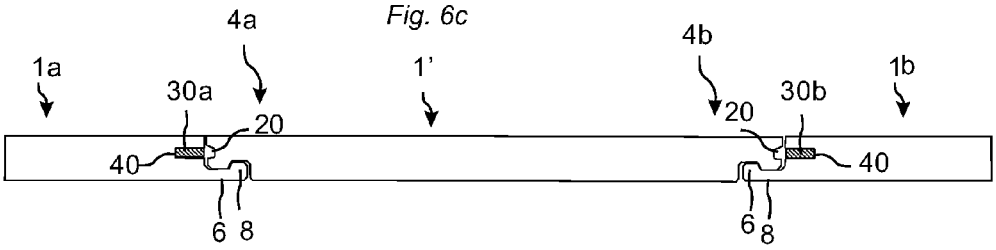
FIG. 6*c* show an embodiment of a floor panel, which is easy to disconnect, provided with a magnetic locking system.

FIG. 6*c* shows that a panel could be produced such that it could be locked with magnetic tongues 30*a*, 30*b* on, for example, both opposite short edges and on at least on long edge. The releasable panel 1' has two essentially identical short edges 4*a*, 4*b* of the groove type which are connected to two panels 1*a*, 1*b* which also have adjacent essentially identical edges of the strip type. The magnetic tongue 30 is arranged in a groove of the strip panel 1*a*, 1*b*. It could also be arranged in a groove of the groove panel 1'. Such a panel could be locked and unlocked in any position of the floor, even in the centre of an installed floor, with a method characterized in that a magnetic field is applied on the short edges and on at least one long edge. The panel is thereafter preferably release from the other panels by, for example, upwards angling or just with a vertical upwards movement, in case the panel has a locking system on both long edges that allow such vertical movement. Such a releasable panel could also comprise flexible tongues that could be released vertically. A panel with a magnetic tongue on a long edge and a short edge according to FIG. 4*a*, could also be release by angling up, provided that such a panel is installed as a last panel in a row as shown in WO 03/083234 FIG. 35 *e*. The two panels 1*a* and 1*b* in FIG. 6*c* could have opposite short edges designed to fit against a standard panel with a strip and groove side as shown in FIG. 4*a*. Only three special panels 1*a*, 1*b* and 1' are required to allow a disconnection of a floor area according to the above-described method.

The above described locking and unlocking is particularly suitable to be used in floor panels which are intended to be easy to disconnect in order to give access to, for example, equipment installed in the sub floor, for example alarm systems, lightning system, other type of electrical systems etc.

Magnetic fields in combination with parts of magnetic materials could also be used for other function in a floor than just to lock floorboards to each other. For example, floor heating, alarm systems, light and similar electrical devices, mechanical equipment etc. installed, for example, in a floorboard or under the floorboard could be turned on and off, displaced etc. Furniture, partition walls and other objects could be fixed permanently or non-permanently to a floor.

A magnet could also be used to, for example, bring a flexible tongue comprising magnetic material into an unlocked position prior to installation. The magnet could be applied on a floor surface of an installed panel close to an edge section and the magnetic field could pull the magnetic tongue (30) into an unlocked position. A new panel could be arranged with its edge adjacent to the installed panel and the magnet could be removed. The flexible magnetic tongue will then snap towards the initial locked position and lock the edges. The advantage of this method is that the installer will know if the locking systems work or not. If the magnetic principle does not work, installation of a panel will not be possible since the tongue is in a locked position and prevents a vertical movement.

A displaceable tongue made of a metal sheet could be made very thin, for example with a thickness of less than 1.0 mm. Such a tongue could be used to lock very thin flooring. Iron sheets could be galvanized or painted in order to prevent corrosion. A lot of non-magnetic materials such as wood fibre based materials, for example HDF, could be made magnetic with a paint comprising magnetic particles such that they could be attracted by a magnet.

The locking system could be used to lock adjacent edges of wall panels but also to connect a wall panel to a wall with a magnetic tongue that locks into a groove of a strip or clips attached to the wall. Permanent magnets in a wall panel or in a wall of a building combined with magnetic materials in a panel and/or wall could be used to fix a wall panel to a wall. A preferred embodiment is a wall panel comprising magnetic material, which is fixed to a wall comprising permanent magnets. The magnetic material that could be incorporated in the surface, core or balancing layer of a wall panel could consist of, for example, iron strips, metal sheets or metal particles or powder. Surface layers or balancing layers of a high-pressure laminate comprising thermosetting resins are very suitable to combine with magnetic materials. Such wall panels with magnetic materials are very suitable for bathrooms where various types of accessories could be fixed to the wall panel with magnets.

Figure 7A:
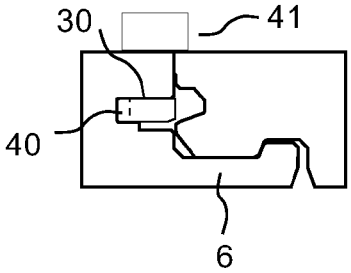
FIGS. 7*a-h* show embodiments of a magnetic locking system provided with a tongue-locking device.
Figure 7B:
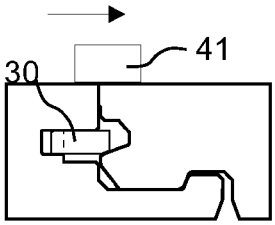
Figure 7C:
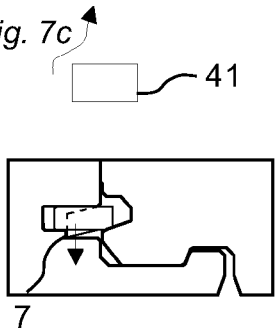
Figure 7D:
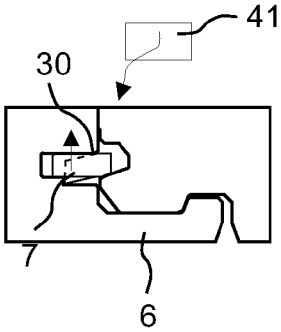
Figure 7E:
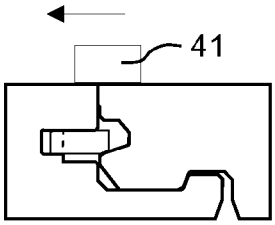
Figure 7F:
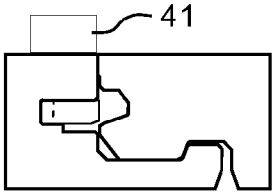
Figure 7G:
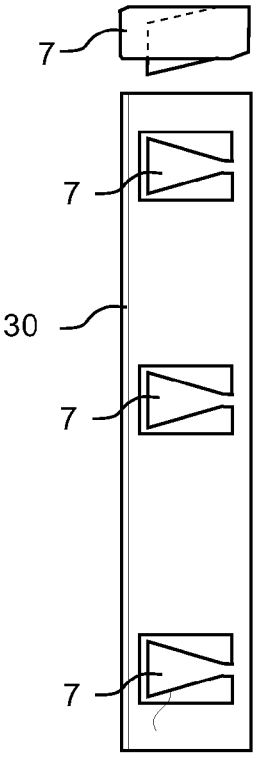
Figure 7H:
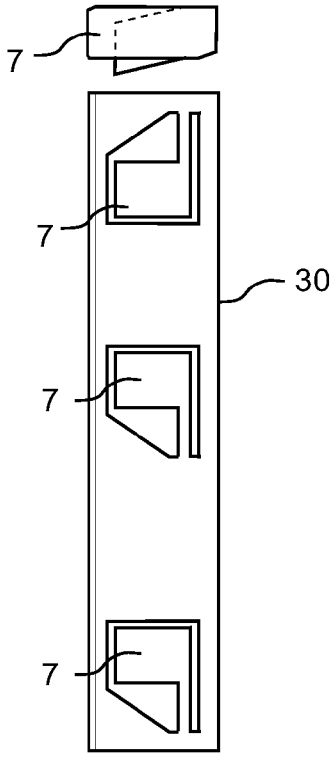
Figure 8A:
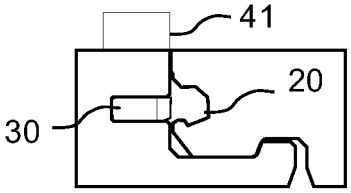
FIGS. 8*a-g* show embodiments of a magnetic locking system provided with a tongue-locking device.
Figure 8B:
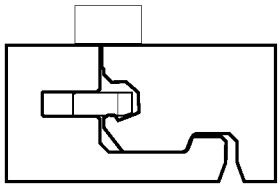
Figure 8C:
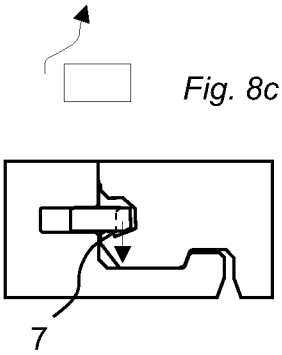
Figure 8D:
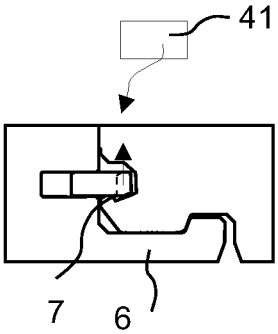
Figure 8E:
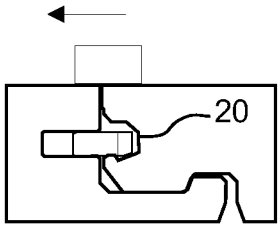
Figure 8F:
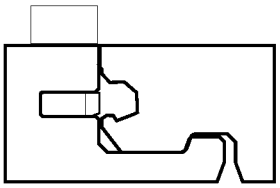
Figure 8G:
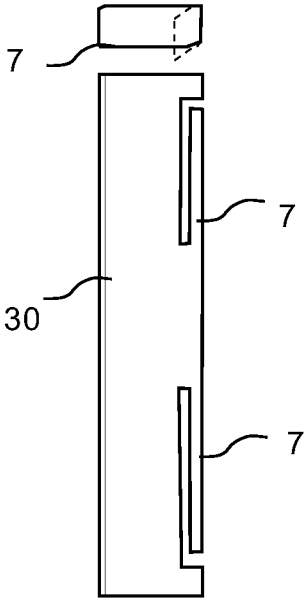

FIGS. 7*a*-7*c* show locking of floor panels comprising a flexible tongue locking device 7 which is maintained in an unlocked position by a magnet 41 and which locks against a lower part of the displacement groove 40 when the magnet is removed. FIGS. 7*d*-7*f* shows that the tongue-locking device 7 could be unlocked with a magnet 41 and the magnetic tongue 30 could be displaced into an unlocked position. FIGS. 7*g* and 7*h* show embodiments of a magnetic tongue with a flexible tongue-locking device 7.

FIGS. 8*a*-8*g* show a flexible and releasable tongue-locking device that locks against the lower part of the tongue groove 20.

Figure 9A:
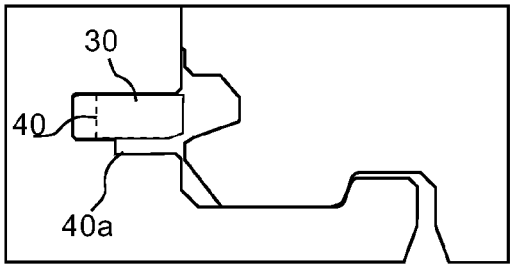
FIGS. 9*a-d* show embodiments of a magnetic locking system provided with a tongue-locking device.
Figure 9B:
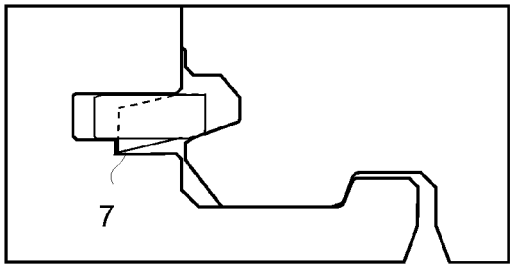
Figure 9C:
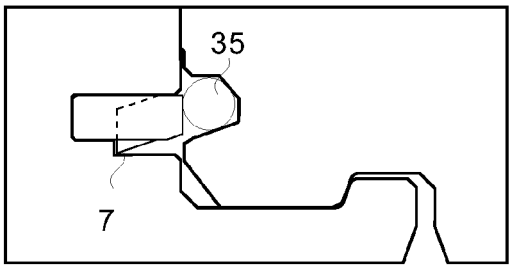
Figure 9D:
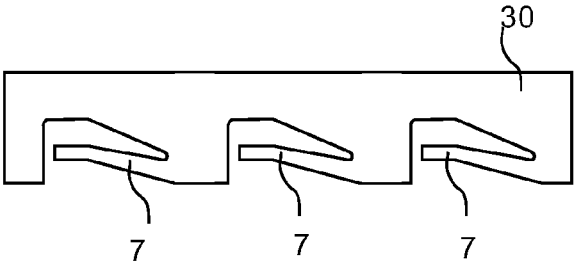

FIG. 9*a*-9*d* show a magnetic tongue 30 with a flexible tongue locking device 7 which locks against a lower part 40*a* of the displacement groove 40 and which could be bent such that the tongue could be displaced into the displacement groove 40 with a unlocking tool 35 that is inserted from the long side along the short side joint. FIG. 9*d* show a magnetic tongue with a flexible tongue locking device 7 that could be bent horizontally in the length direction of the joint and which allows that the tongue could be pushed back into the tongue groove. The tongue-locking device is in this embodiment flexible vertically and horizontally.

Figure 10A:
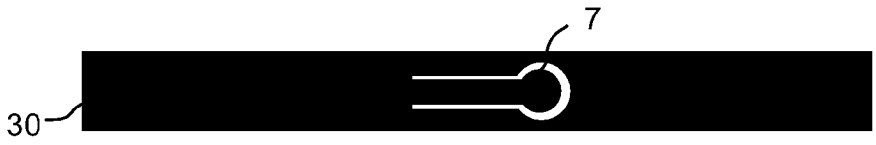
FIGS. 10*a-f* show embodiments of a magnetic tongue.
Figure 10B:
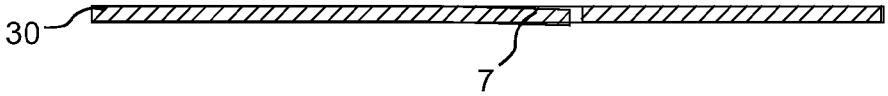
Figure 10C:
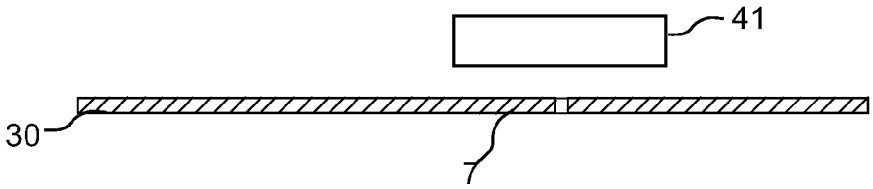
Figure 10D:
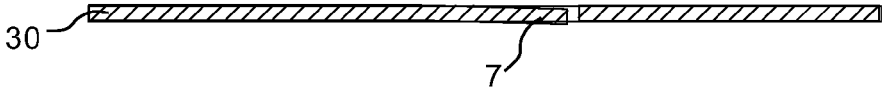

FIG. 10*a* is a top view of a magnetic tongue with a flexible tongue-locking device, which could be unlocked upwardly by a magnet as shown in the side view according to FIG. 10*c*. FIG. 10*d* show that the tongue-locking device will return to the locked position if the magnet 41 is removed.

Figure 10E:
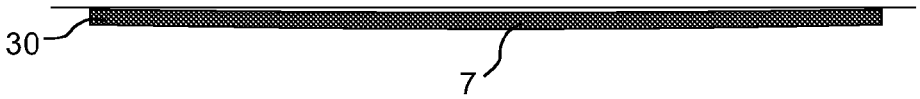
Figure 10F:
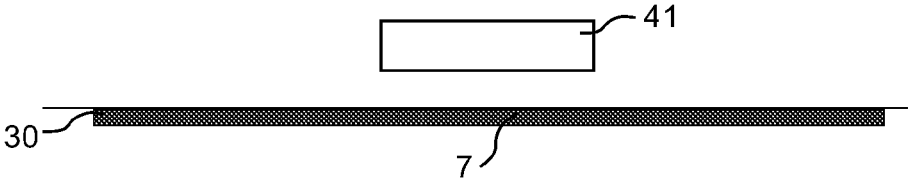

FIG. 10*e* shows that a flexible friction connection that keeps the tongue in the displacement groove and prevents unlocking could be accomplished with a flexible tongue 30, which comprises at least one section, preferably a middle section that is slightly bended downwards such that a vertical pre tension is obtained in the displacement groove. The tongue has preferably an upper surface, which is smooth and a lower section which is embossed and which preferably creates a higher friction then the upper surface. The pre tension is released when a magnet 41 is applied above the tongue as can be seen in FIG. 10*f*.

Figure 11A:
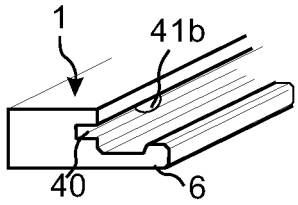
FIGS. 11*a-e* show embodiments of a magnetic locking system.
Figure 11B:
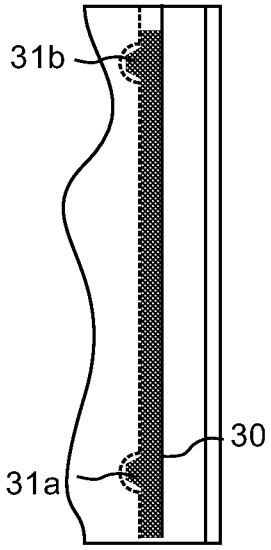
Figure 11C:
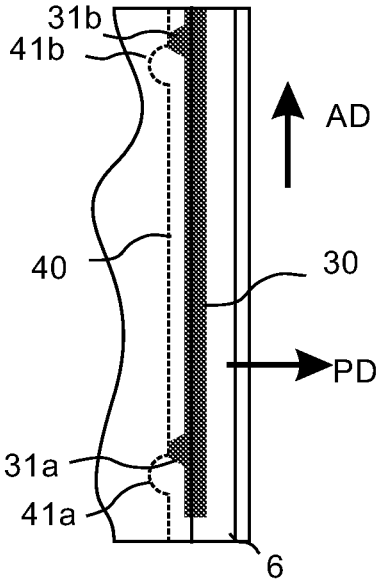
Figure 11D:
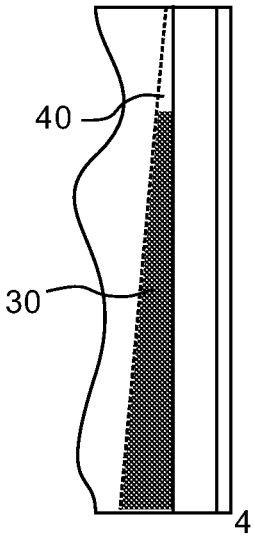
Figure 11E:
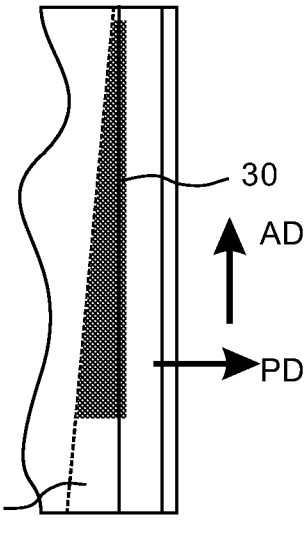

FIGS. 11*a*-11*c* show that groove cavities 41*a, b* could be formed that cooperates with a tongue protrusion 31*a,b* such that a tongue could be displaced perpendicularly PD to the edge but also along the edge AD such that the protrusions leave the cavities and prevent a displacement into the displacement groove. Such a tongue-locking device could also be accomplished with a wedge shaped tongue and displacement groove. The tongue 30 moves in two directions PD, AD as shown in FIG. 11*d,e*.

Figure 12A:
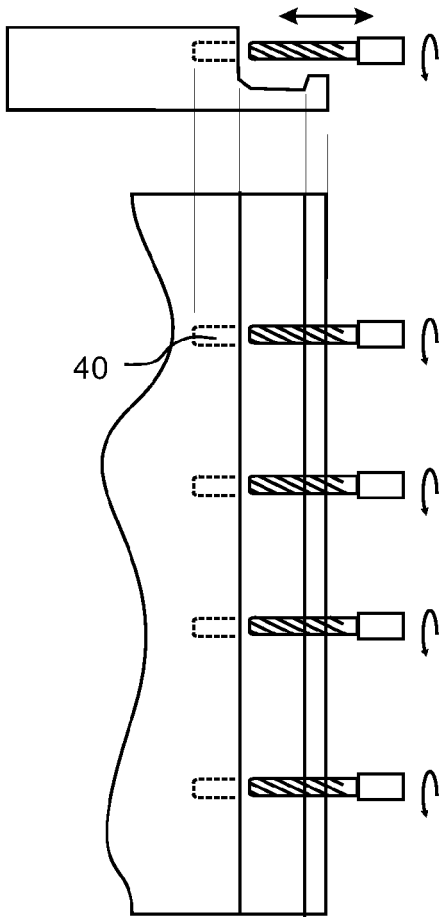
FIGS. 12*a-c* show embodiments of a magnetic locking system comprising several magnetic tongues and a production method.
Figure 12B:
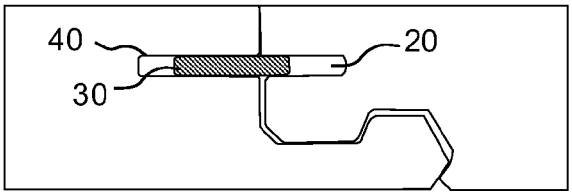
Figure 12C:
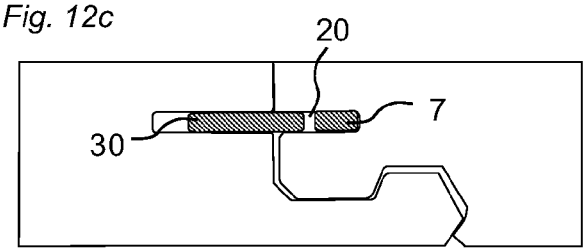

FIGS. 12*a*-*b* show that a tongue could consist of one or several displaceable magnetic pins 30, which are located in cavities 40, e.g. bore holes. FIG. 12*c* shows that a tongue-locking device 7 could be obtained by a magnet, which is inserted in a tongue groove 20 in order to keep the tongue in a locked position.

Figure 13A:
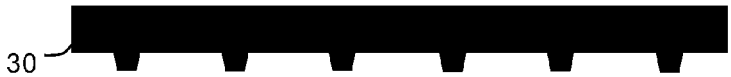
FIGS. 13*a-f* show embodiments of a magnetic locking system provided with a tongue-locking device.
Figure 13B:
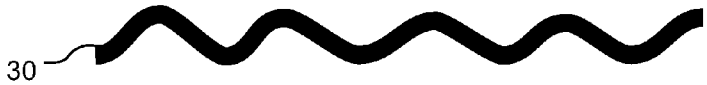
Figure 13C:
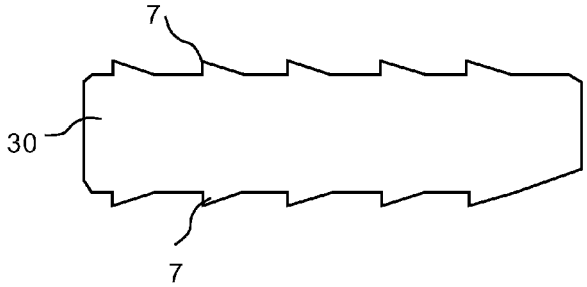
Figure 13D:
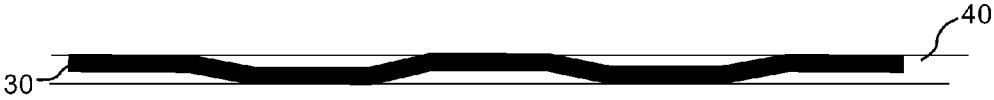
Figure 13E:
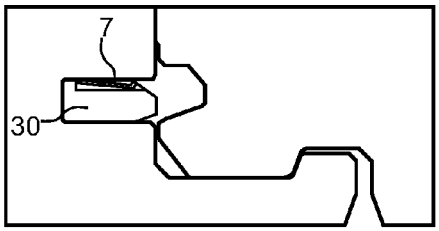
Figure 13F:
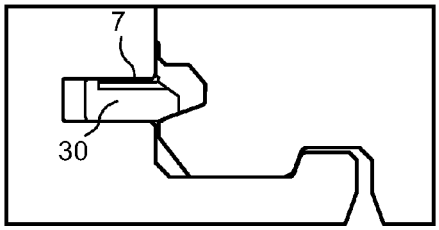

FIG. 13*a*-*b* show that the tongue 30 could have a width that varies along the length or that it could be formed as a very simple bended metal piece or wire. Such embodiments could be used to accomplish flexibility, friction, pre tension and easy displacement. FIG. 13*c* shows a tongue 30 with a tongue-locking device comprising several sharp protrusions 7 that is easy to displace towards a locked position but which creates a locking force in the reverse position. FIG. 13*d* show a side view of a magnetic tongue that is made of a thin material and formed such that it could be inserted into a displacement groove 40 that has an opening which is larger the material thickness of the tongue. FIGS. 13*e*-*f* show that a flexible tongue-locking device 7 could be formed on the upper part of the tongue 30.

Figure 14A:
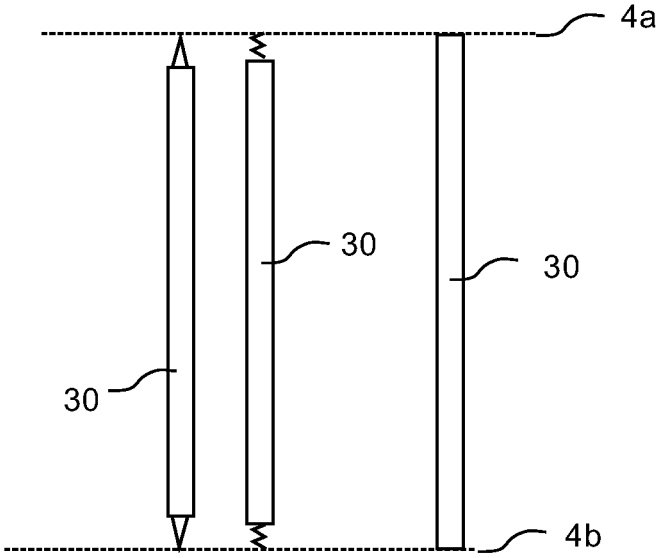
FIG. 14*a* shows an embodiment of a magnetic locking system provided with a tongue-locking device.
Figure 14B:
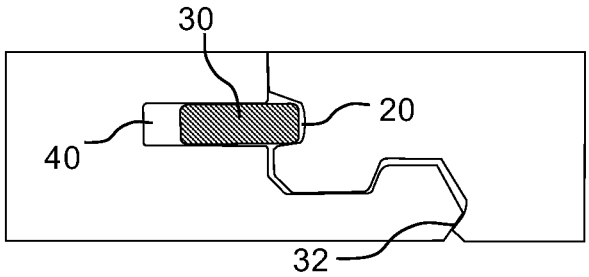
FIG. 14*b* shows an embodiment of a magnetic locking system.
Figure 15A:
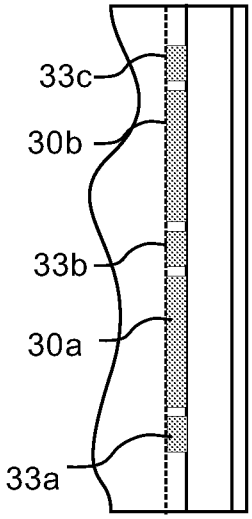
FIGS. 15*a-d* show an embodiment of a magnetic locking system.
Figure 15B:
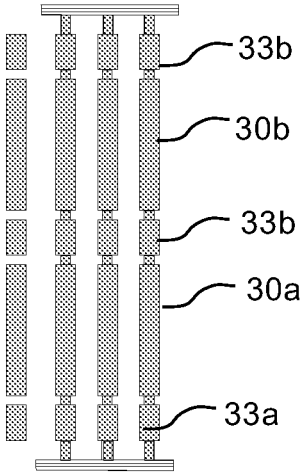
Figure 15C:
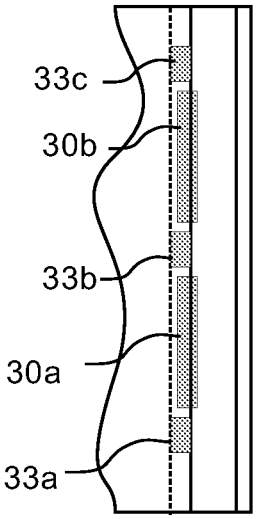
Figure 15D:
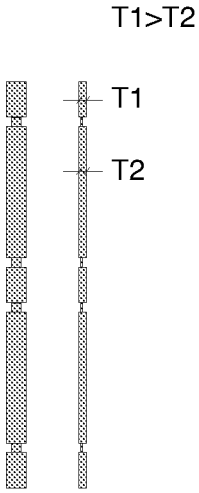

FIG. 14*a* show that a tongue-locking device could be formed as an edge section that locks against the long edges 4*a*, 4*b* of adjacent panels in adjacent rows. FIG. 14*b* shows that secondary vertical connection 32 could be formed preferably in one piece with the panel body such that the edges are locked and kept aligned until the magnetic tongue is locked into the tongue groove.

FIG. 15*a*-*d* show that one or several magnetic tongues 30*a*,30*b* could be combined with separate distance devices 33*a*, 33*b*, 33*c* that are inserted into the displacement groove and that ensures that the opening of the displacement groove is such that a pre-determined friction and displacement could be accomplished. The thickness T1 of the distance devices should preferably exceed the thickness T2 of the tongue.

Figure 16A:
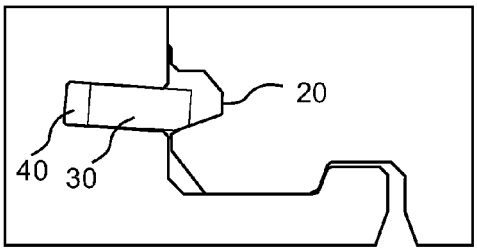
FIGS. 16*a-d* show embodiments of a magnetic locking system provided with a tongue-locking device.
Figure 16B:
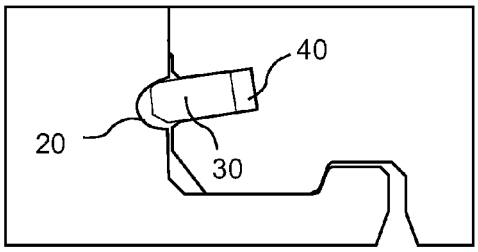

FIG. 16*a*-*b* show that grooves inclined against the main plane of the panels and gravity could be used to prevent the tongue to unlock.

Figure 16C:
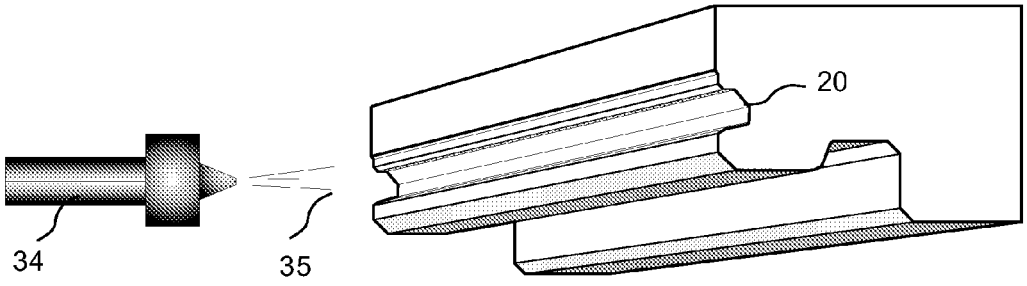
Figure 16D:
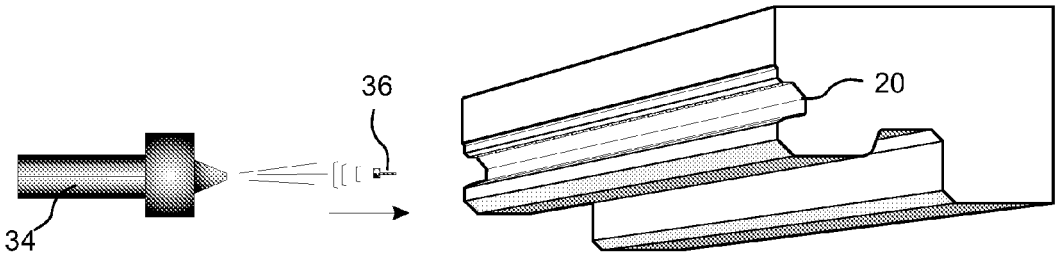
Figure 17A:
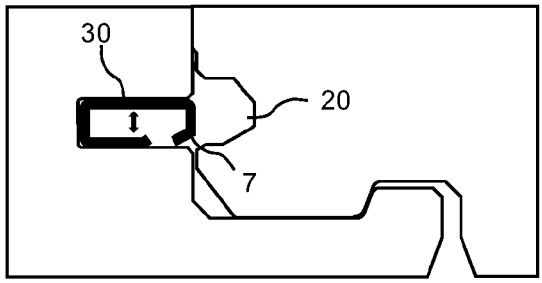
FIGS. 17*a-d* show embodiments of a magnetic locking system provided with a tongue-locking device.
Figure 17B:
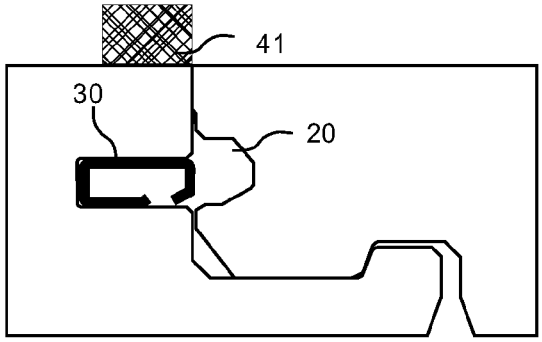
Figure 17C:
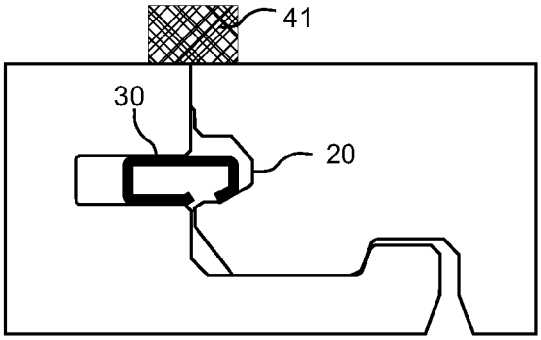
Figure 17D:
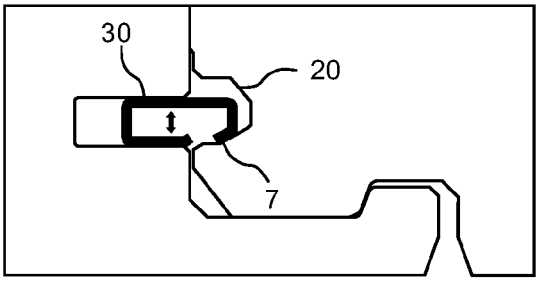
Figure 18A:
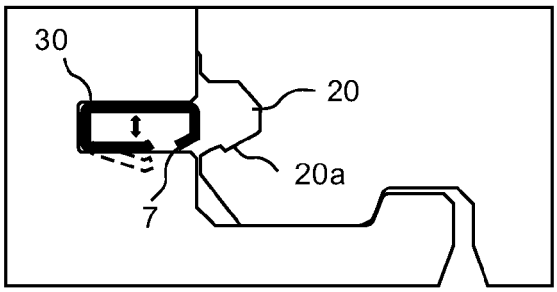
FIGS. 18*a-d* show embodiments of a magnetic locking system provided with a tongue-locking device.
Figure 18B:
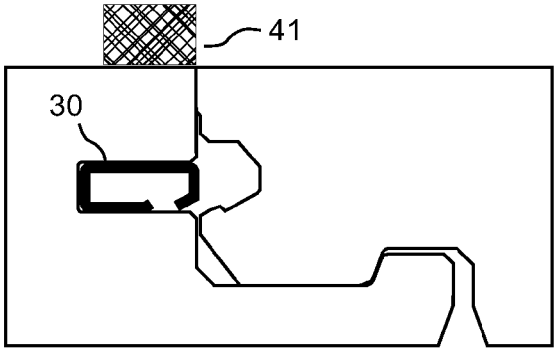
Figure 18C:
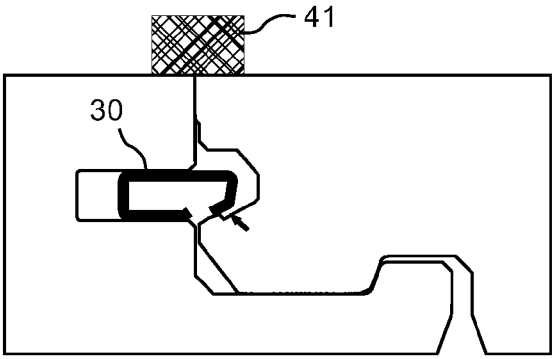
Figure 18D:
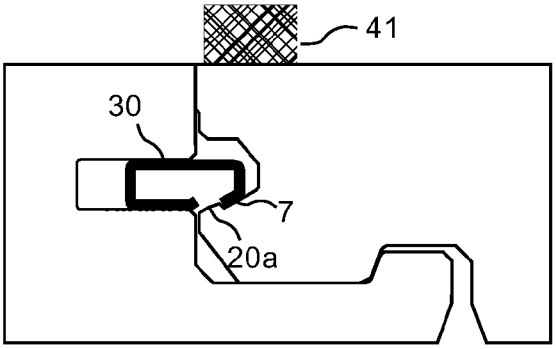

FIG. 16*c* shows that magnetic paint could be applied into the tongue groove 20 in order to secure a tongue, which is configured, to be partly or completely a magnet. FIG. 16*d* shoes that small magnetic nails 36 could also be connected to the edge with an air gun. The small nails 36 could also be small magnets.

FIG. 17*a*-17*d* show a magnetic tongue 30 which is formed as a section with an outer part 7 that locks with a sharp edge against the lower part of the tongue groove 20. FIGS. 18*a*-18*d* show that such a tongue could comprise a tongue-locking device 7 formed as a snap tab, which cooperates with a locking element 20*a* formed in the tongue groove 20.

All principles described above could be used independently or in combinations. The magnetic tongue could be attached at any part of an edge section. A displacement groove or a tongue groove could, for example, be formed at the outer part of the protruding strip.

A magnetic tongue could comprise one or several locking elements that lock in the horizontal direction such that a displacement perpendicular and along the joint locks the edges horizontally and vertically.

A magnetic tongue could comprise tongue protrusions that match cavities in a tongue groove of an adjacent panel. The tongue groove could also comprise groove protrusions such that the edges are locked vertically when the magnetic tongue is displaced with a magnetic force along the edge and the tongue and groove protrusions are overlapping each other.

The invention claimed is:

1. A tongue adapted for being received in a sidewardly open groove of a floor panel, wherein the tongue is formed of resinous material and comprises magnetic powder or particles dispersed within the resinous material, and wherein the resinous material has an upper sliding surface on an upper part of the tongue that is a configured to face a front face of the floor panel, and an opposed lower sliding surface on a lower part of the tongue that is configured to face a rear face of the floor panel, the upper and lower sliding surfaces of the resinous material configured to slide against inner surfaces of the sidewardly open groove of the floor panel during locking of the floor panel with an adjacent floor panel.

2. The tongue as claimed in claim 1, wherein the magnetic powder or particles comprises iron, nickel or cobalt.

3. The tongue as claimed in claim 1, wherein the tongue is injection molded.

4. The tongue as claimed in claim 1, wherein the tongue comprises wood fibers, iron powder and a thermosetting binder.

5. The tongue as claimed in claim 1, wherein the tongue has a cross-sectional shape that corresponds to a cross-sectional shape of the sidewardly open groove into which the tongue is configured to be received.

6. The tongue as claimed in claim 1, wherein the magnetic powder or particles dispersed within the resinous material is only at an edge section of the tongue.

7. The tongue as claimed in claim 1, wherein the tongue is configured to lock the floor panel with a similar floor panel in a vertical direction perpendicular to a main plane of the floor panel.

8. The tongue as claimed in claim 1, wherein at least two corners of the tongue in plan view of the upper part of the tongue each have an edge part that is chamfered.

* * * * *